US011142817B2

(12) United States Patent
Cadotte et al.

(10) Patent No.: US 11,142,817 B2
(45) Date of Patent: Oct. 12, 2021

(54) ROLL FOR USE IN A HOT DIP COATING LINE

(71) Applicant: AK Steel Properties, Inc., West Chester, OH (US)

(72) Inventors: Daniel J. Cadotte, Middletown, OH (US); Joyce C. Niedringhaus, Liberty Township, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 0 days.

(21) Appl. No.: 16/546,539

(22) Filed: Aug. 21, 2019

(65) Prior Publication Data

US 2019/0376171 A1 Dec. 12, 2019

Related U.S. Application Data

(63) Continuation-in-part of application No. 16/226,895, filed on Dec. 20, 2018.

(60) Provisional application No. 62/609,040, filed on Dec. 21, 2017.

(51) Int. Cl.

| | |
|---|---|
| ***C23C 2/06*** | (2006.01) |
| ***C23C 2/40*** | (2006.01) |
| ***C23C 2/00*** | (2006.01) |

(52) U.S. Cl.

CPC ..... *C23C 2/06* (2013.01); *C23C 2/003* (2013.01); *C23C 2/40* (2013.01); *Y10T 29/49565* (2015.01)

(58) Field of Classification Search

CPC ..... C23C 2/003; Y10T 29/49565
USPC ..... 492/58, 59
See application file for complete search history.

(56) References Cited

U.S. PATENT DOCUMENTS

| | | | | |
|---|---|---|---|---|
| 117,985 | A | 8/1871 | Collier | |
| 317,781 | A | 5/1885 | Hemphill | |
| 831,727 | A | 9/1906 | Loomis | |
| 1,305,330 | A | 6/1919 | Woleven et al. | |
| 2,115,465 | A | 4/1938 | Merten | |
| 2,695,248 | A | 11/1954 | Ornitz et al. | |
| 3,577,619 | A * | 5/1971 | Strandel | B21B 27/035 29/895.212 |
| 3,595,207 | A * | 7/1971 | Stricker | C23C 2/003 118/420 |
| 3,664,293 | A * | 5/1972 | Hozumi | C23C 2/003 118/665 |

(Continued)

FOREIGN PATENT DOCUMENTS

| | | |
|---|---|---|
| CN | 204898045 U | 12/2015 |
| DE | 102012103132 | 5/2013 |

(Continued)

OTHER PUBLICATIONS

International Search Report and Written Opinion dated Mar. 21, 2019 for Application No. PCT/US2018/066702, 11 pgs.

(Continued)

*Primary Examiner* — Jason L Vaughan
(74) *Attorney, Agent, or Firm* — Frost Brown Todd LLC

(57) ABSTRACT

A continuous coating line includes a roll assembly exposed to molten metal. The roll assembly includes a roll rotatable relative to a bearing block. The roll includes a roll portion and a journal protruding from each end of the roll portion. The roll is made from a refractory ceramic material that is resistant to wear, abrasion, and corrosion when the roll is exposed to the molten metal.

18 Claims, 22 Drawing Sheets

(56) References Cited

U.S. PATENT DOCUMENTS

| | | | | |
|---|---|---|---|---|
| 3,734,579 | A | 5/1973 | Schumacher | |
| 3,861,012 | A * | 1/1975 | Spaeder, Jr. | B21B 27/03 492/3 |
| 3,927,449 | A * | 12/1975 | Gibble | F16C 3/02 29/895.33 |
| 4,416,137 | A * | 11/1983 | Marshall | B21B 27/02 492/1 |
| 5,072,689 | A * | 12/1991 | Nakagawa | F16C 33/043 118/419 |
| 5,411,462 | A * | 5/1995 | Link | B41F 31/26 492/30 |
| 5,538,558 | A * | 7/1996 | Ookouchi | C23C 2/003 118/419 |
| 5,538,559 | A | 7/1996 | Kleimeyer et al. | |
| 5,571,328 | A | 11/1996 | Newland | |
| 5,667,310 | A * | 9/1997 | Oyagi | B05C 3/12 384/137 |
| 5,711,613 | A * | 1/1998 | Ookouchi | C23C 2/003 384/283 |
| 5,718,766 | A * | 2/1998 | Vignot | C23C 2/00 118/419 |
| 6,554,904 | B1 * | 4/2003 | Gimpel | B65G 39/09 118/419 |
| 8,210,999 | B2 * | 7/2012 | Hamayoshi | C04B 35/593 492/3 |
| 8,915,830 | B2 * | 12/2014 | March | B65G 39/02 492/45 |
| 2003/0133632 | A1 | 7/2003 | Hall | |
| 2010/0064968 | A1 | 3/2010 | Challaye | |
| 2015/0068454 | A1 | 3/2015 | Blumenau et al. | |
| 2018/0002796 | A1 | 1/2018 | Niedringhaus et al. | |
| 2019/0161842 | A1 | 5/2019 | Niedringhaus et al. | |

FOREIGN PATENT DOCUMENTS

| | | | |
|---|---|---|---|
| EP | 0 292 953 | A1 | 11/1988 |
| EP | 0346855 | | 12/1989 |
| EP | 0 524 851 | A1 | 1/1993 |
| FR | 2 921 135 | A1 | 3/2009 |
| JP | S55-150549 | | 1/1980 |
| JP | H02-030310 | | 1/1990 |
| JP | H05-070915 | | 3/1993 |
| JP | H05-287475 | A | 11/1993 |
| JP | 2000-233986 | | 8/2000 |
| JP | 2001-234924 | | 8/2001 |
| JP | 2003-306753 | | 10/2003 |
| WO | WO 2010/111341 | | 9/2010 |
| WO | WO 2012/136713 | A1 | 10/2012 |
| WO | WO 2016/103044 | | 6/2016 |

OTHER PUBLICATIONS

Thiruvenga, A. et al, "Mechanical Properties of Metals and their Cavitation Damage Resistance," Hydronautics Incorporated, Office of Naval Research Department of the Navy, Contract No. Nonr 3755(00) (FBM) 062-203, Jun. 1964, pp. 1-47.

Rosenflanz, A., "Silicon Nitride and Sialon Ceramics," Current Opinion in Solid State and Materials Science vol. 4, 1999, pp. 453-459.

Saint Gobain Ceramics, "Advancer Silicon Nitride Bonded Silicon Carbide," Technical Bulletin, Jan. 2005 1 page.

European Communication dated Dec. 6, 2018 for Application No. 17724668.3, 3pgs.

International Search Report and Written Opinion dated Aug. 25, 2017 for Application No. PCT/US17/30398.

Taiwanese Office Action dated Aug. 29, 2018 for Application No. 106114406 14 pgs.

U.S. Appl. No. 15/538,450.

U.S. Appl. No. 16/226,895.

U.S. Appl. No. 16/263,044.

* cited by examiner

ROLL FOR USE IN A HOT DIP COATING LINE

The present application is a continuation-in-part of U.S. patent application Ser. No. 16/226,895, entitled "A Roll For Use in a Hot Dip Coating Line," filed on Dec. 20, 2018, which claims priority to U.S. Provisional Patent Application Ser. No. 62/609,040, entitled "Pot/Sink Stabilizer/Correcting Rolls for Hot Dip Coating Lines Manufactured from Refractory/Ceramic Utilizing Either a One-Piece Solid or Hollow Tube Design," filed on Dec. 21, 2017, the disclosures of which are incorporated by reference herein.

BACKGROUND

Coating is a common process used in steel making to provide a thin metal coating (e.g., aluminum, zinc, etc.) on the surface of a steel substrate, such as an elongated steel sheet or strip. It should be understood that an elongated steel sheet or strip are used and understood herein to be interchangeable. The coating process may be generally incorporated into a continuous coating line where an elongated steel sheet is threaded through a series of roll assemblies to subject the steel sheet to various treatment processes. During the coating portion of this process, the steel sheet is manipulated through a bath of molten metal to coat the surfaces of the steel sheet.

Referring to FIG. 1, an illustrative schematic of a coating portion (10) of a steel processing line (2), such as a continuous steel processing line, is shown. As can be seen, coating portion (10) includes a hot dip tank (20), a snout (30), one or more roll assemblies (40, 50, 70), and air knives (35). Coating portion (10) is generally configured to receive an elongated steel sheet (60) for coating steel sheet (60). Hot dip tank (20) is defined by a solid wall configured to receive molten metal (22), such as aluminum, zinc, and/or alloys thereof.

Snout (30) is configured to be partially submerged within molten metal (22). Accordingly, snout (30) generally provides an air tight seal around steel sheet (60) during entry into molten metal (22). In some instances, snout (30) is filled with a nonreactive or reducing gas such as hydrogen and/or nitrogen to limit chemical oxidation reactions that may occur during entry of steel sheet (60) into molten metal (22).

One or more roll assemblies (40, 50, 70) are positioned relative to hot dip tank (20) to support steel sheet (60) through coating portion (10). For instance, a pot or sink roll assembly (70) may be submerged within molten metal (22) such that pot roll assembly (70) is generally configured to rotate and thereby redirect steel sheet (60) out of hot dip tank (20). One or more stabilizer and correcting roll assemblies (40) may then be positioned relative to hot dip tank (20) to stabilize steel sheet (60) as steel sheet (60) exits molten metal (22). For instance, stabilizer and correcting roll assemblies (40) may be used to position steel sheet (60) as steel sheet (60) enters air knives (35). Stabilizer and correcting roll assemblies (40) may also be used to improve the shape of steel sheet (60). A deflector roll assembly (50) may then be generally configured to redirect steel sheet (60) to other portions of steel processing line (2) after steel sheet (60) has been coated. While the coating portion (10) of the present example is shown with only one of each of a pot roll assembly (70), a stabilizer and correcting roll assembly (40), and a deflector roll assembly (50), in some other versions any suitable number of roll assemblies (40, 50, 70) may be used.

FIG. 1A shows an alternative configuration of coating portion (10) with stabilizer and correcting roll assembly (40) omitted. In lieu of, or in alternative to, stabilizer and correcting roll assembly (40), the alternative configuration shown in FIG. 1A includes two sink roll assemblies (42) disposed entirely within hot dip tank (20). Sink roll assemblies (42) generally operate similarly to other roll assemblies described herein. For instance, sink roll assemblies (42) are generally configured to manipulate steel sheet (60) through various portions of the coating process. In the present example, sink roll assemblies (42) manipulate steel sheet (60) within molten metal (22) to promote complete coating of steel sheet (60). Sink roll assemblies (42) additionally provide for an increased amount of travel path through molten metal (22). This feature generally increases the time in which steel sheet (60) is disposed within molten metal (22). Once steel sheet (60) passes through sink roll assemblies (42), steel sheet (60) may then be redirected in a desired direction by stab roll assembly (70) and deflector roll assembly (50). It should also be understood that although FIGS. 1 and 1A both illustrate discrete configurations for coating portion (10), in other examples coating portion (10) includes other alternative configurations that combine various elements from the configurations shown in FIGS. 1 and 1A.

As described in the examples above, to aid in manipulation of the steel sheet, various roll assemblies may be disposed in and/or exposed to molten metal as part of a coating portion (10). Typically, each roll assembly comprises a roll rotatable with the steel sheet. FIG. 2 shows an example of a typical prior art roll (80) comprising a roll portion (82) with a pair of journals (84) extending outwardly from each end of roll portion (82). These rolls are generally made from steel, such as stainless steel and/or carbon and alloy steel. These rolls may be formed by a single integral component or manufactured from a hollow tube with journal hubs welded onto each end, as shown in FIG. 2. In some versions, a roll may be configured for a stabilizer application and may weigh about 750 pounds.

Due to continuous movement of the roll assemblies and/or the harsh environment caused by the molten metal, these rolls may be subject to chemical attack, corrosion, abrasion, and/or wear. For instance, a combination of friction and contact stresses between the steel sheet and the roll, the dissolution of the steel roll in molten metal, the high temperature of the molten metal, and cavitation may result in relatively rapid degradation of the roll surface. To delay such issues, in some versions, the exterior surface of the roll is covered with a thin layer, such as about 0.030 inches, of ceramic or a ceramic and metallic barrier coating applied by a thermal spray process. Such a protective coating may delay and/or minimize metallurgical and mechanical attack of and intermetallic dross accumulation on the exterior surface of the roll. The success of the protective coating in the service environment may depend on the coating's bond strength, hardness, and/or porosity. Even with such a coating, the roll may still experience deterioration, as shown in FIG. 3.

When wear or deterioration on either the roll journal or the roll portion reaches an unacceptable level, the continuous coating line is shut down and the components therein are reworked and/or replaced. This procedure generally results in increased costs and undesirable manufacturing delays. However, these costs and delays may be reduced by increasing the service life of roll assemblies exposed to molten metal.

Accordingly, it may be desirable to include various features within a coating line to improve the overall service life of components subject to wear and/or deterioration. To overcome these challenges, a roll assembly is made from a refractory material to reduce the amount of wear, abrasion, and/or corrosion on the roll assembly.

SUMMARY

Roll assemblies positioned within coating lines encounter at least some abrasion and chemical attack when used within coating baths for coating processes. Under some circumstances, this abrasion and/or chemical attack may lead to reduced duty cycles for such roll assemblies. Thus, it is desirable to reduce abrasion and/or chemical attack encountered with roll assemblies used in coating processes.

Refractory materials, such as ceramic, provide superior resistance to abrasion and chemical attack encountered in environments surrounded by molten metal. However, challenges have been encountered with integrating refractory materials into roll assemblies exposed to molten metal. Thus, the present application relates to structures and/or methods for incorporating refractory materials into roll assemblies.

BRIEF DESCRIPTION OF THE FIGURES

The accompanying figures, which are incorporated in and constitute a part of this specification, illustrate embodiments, and together with the general description given above, and the detailed description of the embodiments given below, serve to explain the principles of the present disclosure.

DETAILED DESCRIPTION

The present application generally relates to structures and/or methods for incorporating a refractory ceramic material within a roll assembly of a continuous coating line. In such a configuration, it has been found that the presence of the refractory ceramic material may reduce wear on the roll assembly and may also reduce the propensity of the roll assembly to be subject to chemical attack from the molten metal.

Embodiments of a roll assembly incorporating refractory ceramic materials are discussed in more detail below. Because such roll assemblies may reduce wear, corrosion, and/or abrasion of the roll assembly, it should be understood that any element of such a roll assembly may be incorporated into any one or more roll assemblies in a continuous coating line. These roll assemblies may include, but are not limited, to any stabilizing and correcting roll assemblies (40), sink roll assemblies (42), deflector roll assemblies (50), and/or pot roll assemblies (70) as described above.

I. A ROLL ASSEMBLY COMPRISING A REFRACTORY ROLL

Figure 4:
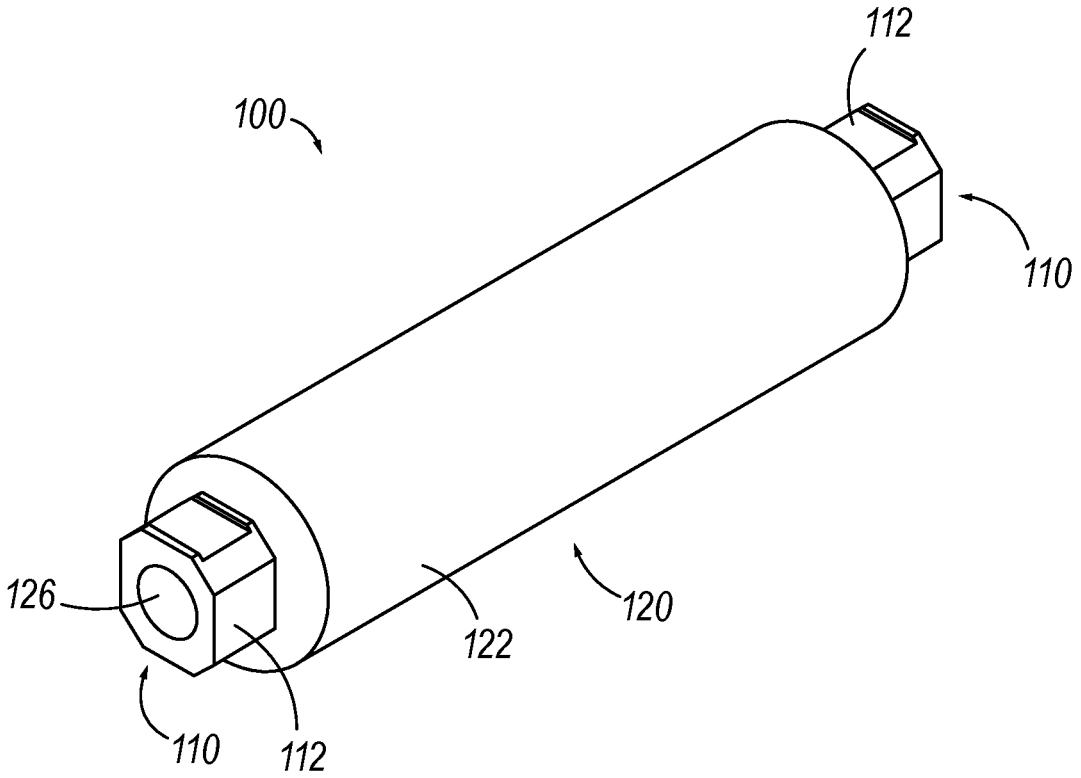
FIG. 4 depicts a perspective view of a roll assembly comprising refractory ceramic material for use with the coating portion of FIG. 1

Referring to FIG. 4, roll assembly (100) comprises two bearing blocks (110) and a roll (120). Each bearing block (110) is generally configured to receive at least a portion of roll (120) to promote rotation of roll (120) relative to bearing block (110). Although not shown, it should be understood that each bearing block (110) may be generally coupled to a fixture or other structure to hold each bearing bock (110) in position within hot dip tank (20).

Figure 5:
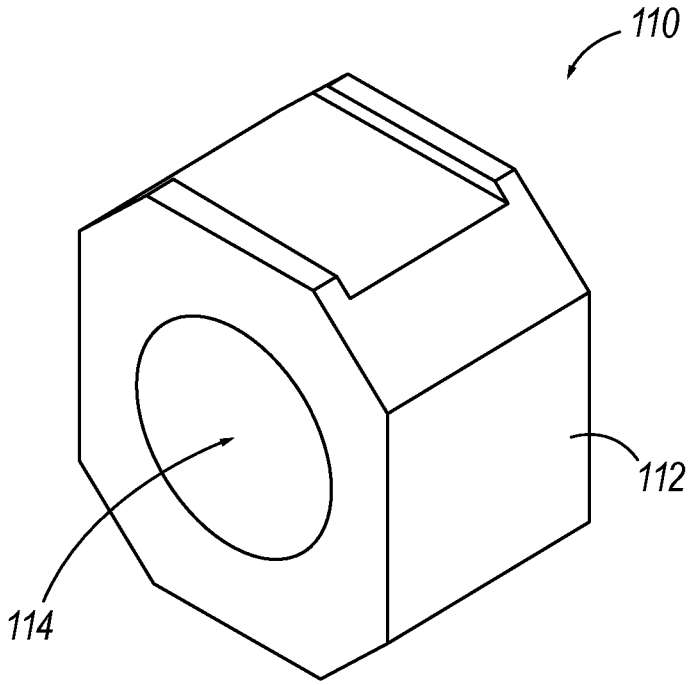
FIG. 5 depicts a perspective view of a bearing block of the roll assembly of FIG. 4.

An illustrative bearing block (110) is best seen in FIG. 5. As can be seen, bearing block (110) includes a generally octagonal body (112). The octagonal shape of body (112) is generally configured to provide surfaces by which a fixture or other structure can attach to bearing block (110) to position bearing block (110) within hot dip tank (20). Although body (112) of the present example is shown with octagonal structure, it should be understood that in other examples other suitable structures may be used such as square, hexagonal, triangular, circular, and/or etc.

Regardless of the particular shape used for body (112), body (112) defines a receiving bore (114) through the center of bearing block (110). Receiving bore (114) is defined by a generally cylindrical shape. As will be described in greater detail below, receiving bore (114) is configured to receive at least a portion of roll (120) to permit roll (120) to freely rotate within bore (114). Accordingly, a portion of an exterior surface of each journal (126) is in direct contact with a portion of an interior surface of bore (114) of bearing block (110). Bearing block (110) may thereby form a plain bearing with each journal (126) without the use of rollers or rolling bodies. Each journal (126) may then be rotated within a stationary bearing block (110). Bearing block (110) may comprise a refractory material, such as ceramic, as will be discussed in more detail below.

Figure 6:
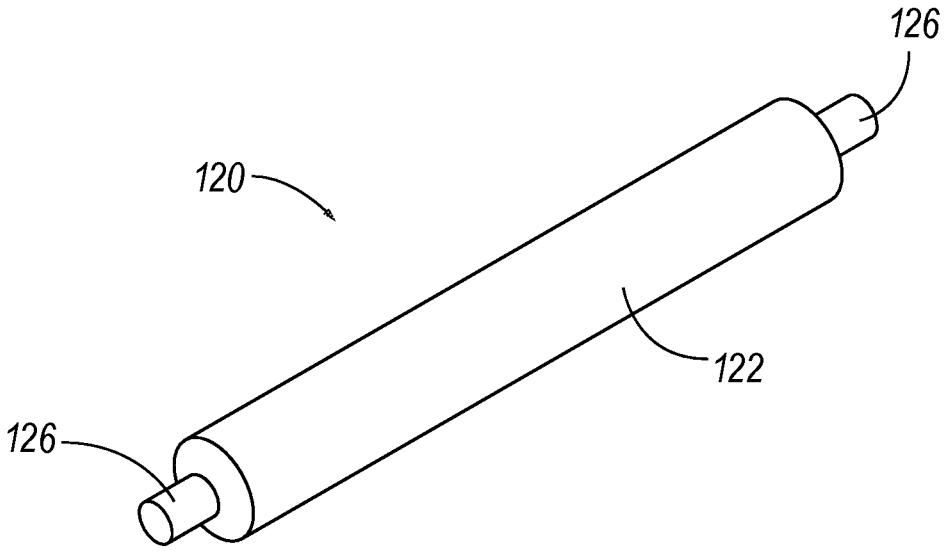
FIG. 6 depicts a perspective view of a roll of the roll assembly of FIG. 4.
Figure 7:
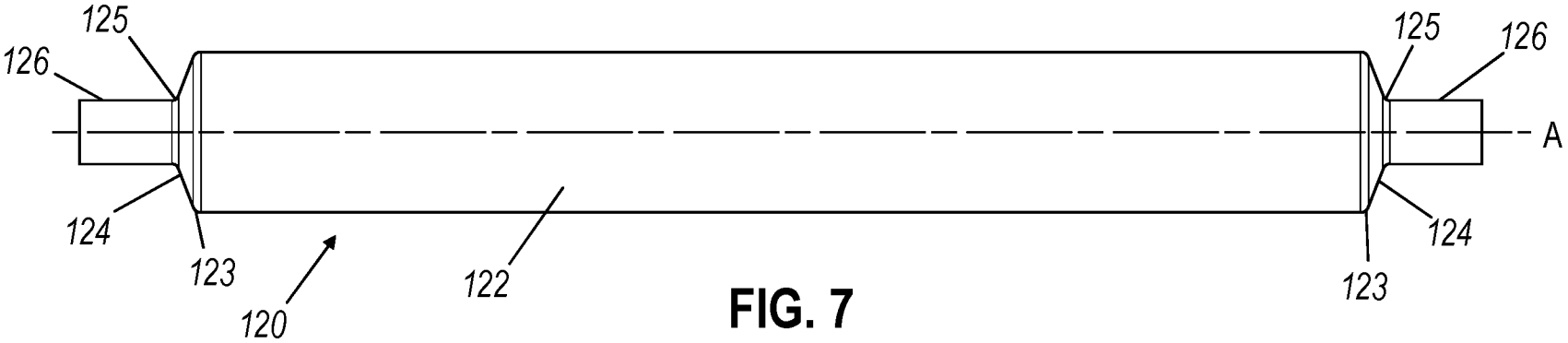
FIG. 7 depicts a front view of the roll of FIG. 6.
Figure 8:
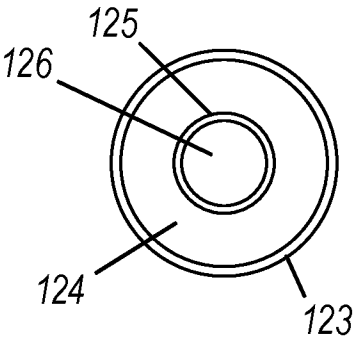
FIG. 8 depicts an end view of the roll of FIG. 6.

Referring to FIGS. 6-8, roll (120) of roll assembly (100) comprises a roll portion (122) and a journal (126) extending from each side of roll portion (122). Roll portion (122) comprises a generally elongate cylindrical shape extending longitudinally along axis (A). The cylindrical shape of roll portion (122) is generally configured to receive steel sheet (60) to permit at least a portion of steel sheet (60) to wrap around at least a portion of roll portion (122). Thus, it should be understood that a width of roll portion (122) generally corresponds to the width of steel sheet (60) such that the width of roll portion (122) is wider than steel sheet (60). This may compensate for strip tracking through coating portion (10). In one embodiment, roll portion (120) may have an outer diameter of between about 4 inches and 20 inches, such as between about 9 inches and 10 inches, though other suitable dimensions can be used.

As described above, each journal (126) extends outwardly from roll portion (122) along longitudinal axis (A). Each journal (126) comprises a generally cylindrical shape with an outer diameter that is less than the outer diameter defined by roll portion (122). Each journal (126) is sized to be received by bore (114) of a respective bearing block (110). As best seen in FIG. 7, a tapered surface (124) in the illustrated embodiment is positioned between roll portion (122) and journal (126). A chamfer or fillet (123) is also positioned between roll portion (122) and tapered surface (124), and chamfer or fillet (125) is positioned between tapered surface (124) and journal (126). In some versions, tapered surface (124) is omitted such that only a chamfer or fillet is positioned between the roll portion (122) and the journal (126). Tapered surface (124) and/or fillets (123, 125) may thereby distribute stress more uniformly between roll portion (122) and journal (126) to reduce a potential mechanical stress concentration. Tapered surface (124) and/or fillets (123, 125) may also prevent wear on bearing block (110) if journal (126) translates within bearing block (110) such that an outer surface of bearing block (110) comes into contact with an outer surface of roll (120). Roll (120) may comprise a refractory material, such as ceramic, as will be discussed in more detail below.

B. Method of Operation

Roll assembly (100) may be assembled as shown in FIG. 4. For instance, each journal (126) of roll (120) may be inserted within a bore (114) of a corresponding bearing block (110). Accordingly, a portion of an exterior surface of each journal (126) is in direct contact with a portion an interior surface of bore (114) of bearing block (110). Bearing block (110) may thereby form a plain bearing with each journal (126) without the use of rollers. Each journal (126) may then be rotated within a stationary bearing block (110).

In an exemplary use, steel sheet (60) may be manipulated through coating portion (10) by roll assembly (100). For instance, steel sheet (60) may wrap around roll (120) of roll assembly (100). Friction between steel sheet (60) and roll portion (122) of roll (120) may cause roll (120) to rotate as steel sheet (60) move relative to roll assembly (100). Rotation of roll (120) thereby causes corresponding rotation of each journal (126) within a respective bearing block (110).

The refractory ceramic material of journal (126) and/or bearing block (110) may provide resistance to wear between journal (126) and bearing block (110), as well as resistance to thermal shock and/or corrosion. The refractory ceramic material of roll portion (122) may also provide resistance to wear of roll portion (122) from rotation of steel sheet (60), as well as resistance to thermal shock and/or corrosion. Roll assembly (100) may thereby increase the life of coating portion (10) to increase efficiency and/or reduce costs of the coating line. Accordingly, by forming the components of roll assembly (100) from a refractory ceramic material, roll assembly (100) may better withstand and resist mechanical erosion and cavitation than a steel surface or a steel surface with a thermal spray coating. The refractory material of roll assembly (100) thereby prolongs the service life of roll assembly (100).

It will be understood various modifications may be made to this invention without departing from the spirit and scope of it. Therefore, the limits of this invention should be determined from the appended claims.

II. A ROLL ASSEMBLY COMPRISING A REFRACTORY ROLL WITH SUPPORT RODS

Figure 9:
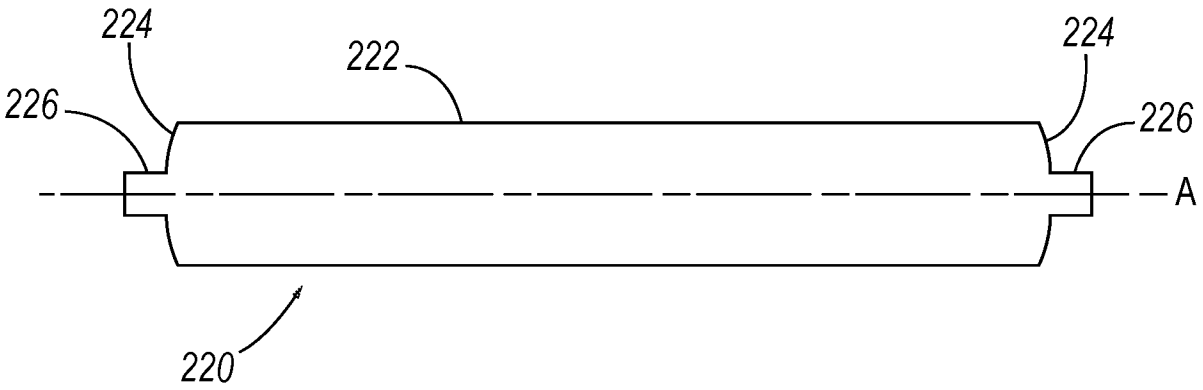
FIG. 9 depicts a front view of an alternative embodiment for the roll of the roll assembly of FIG. 4.
Figure 11:
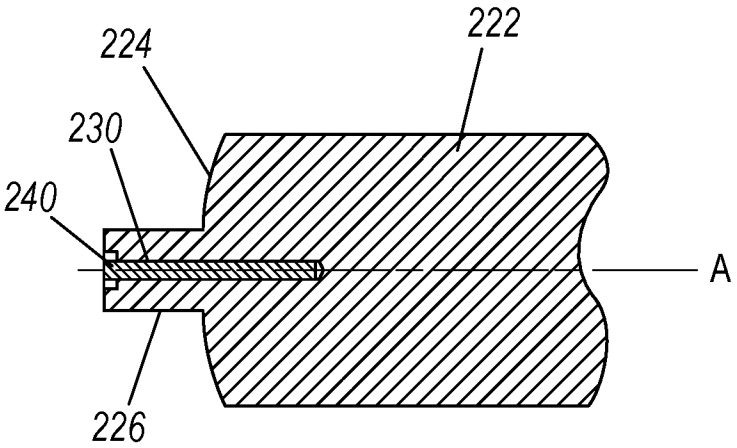
FIG. 11 depicts a partial cross-sectional view of the end portion of the roll of FIG. 9, showing a support rod inserted within the roll.
Figure 10:
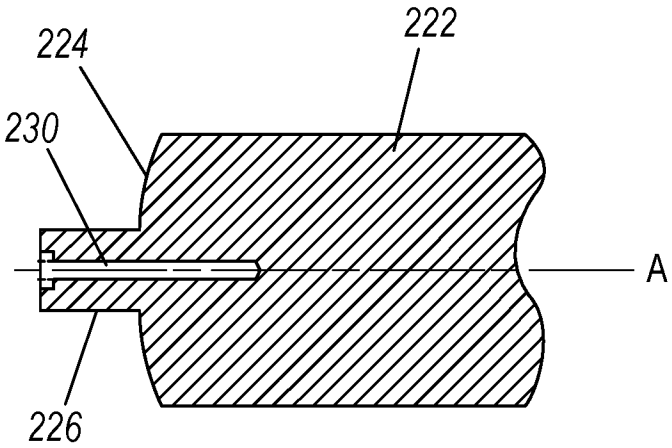
FIG. 10 depicts a partial cross-sectional view of an end portion of the roll of FIG. 9.

Another embodiment of a roll (220) is shown in FIGS. 9-11 that may be incorporated into roll assembly (100). Roll (220) is substantially similar to roll (120), except that roll (220) comprises a pair of support rods (240). As best seen in FIG. 9, roll (220) comprises roll portion (222) and journal (226) extending from each side of roll portion (222). Roll portion (222) comprises a generally elongate cylindrical shape extending longitudinally along axis (A). The cylindrical shape of roll portion (222) is generally configured to receive steel sheet (60) to permit at least a portion of steel sheet (60) to wrap around at least a portion of roll portion (222).

As described above, each journal (226) extends outwardly from roll portion (222) along longitudinal axis (A). Each journal (226) comprises a generally cylindrical shape with an outer diameter that is less than the outer diameter defined by roll portion (222). Each journal (226) is sized to be received by bore (114) of a respective bearing block (110). In the illustrated embodiment, a convex surface (224) is positioned between roll portion (222) and journal (226). Convex surface (224) may distribute stress more uniformly between roll portion (222) and journal (226) and/or reduce wear on bearing block (110). Though it should be noted that convex surface (224) is merely optional and other suitable surfaces may be used, such as straight and/or tapered surfaces.

Referring to FIGS. 10-11, roll (220) defines a channel (230) extending within each end of roll (220) along longitudinal axis (A) of roll (220). In the illustrated embodiment, channel (230) extends through journal (226) and into a portion of roll portion (222). Channel (230) may have a length of about 14 inches and a diameter of about 1.23 inches, but other suitable dimensions can be used. A support rod (240) may thereby be inserted within channel (230) of roll (220). Support rod (240) may be sized to correspond to the length and/or diameter of channel (230) such that support rod (240) is friction fit within channel (230). Of course, other suitable methods may be used to couple support rod (240) with channel (230), such as with a threadable coupling and/or adhesive. Support rod (240) may be made from steel or other suitable material to increase strength to roll (220). Support rod (240) thereby extends through roll (220) between journal (226) and roll portion (222) to help support any mechanical stress concentrations between journal (226) and roll portion (222). Roll (220) may comprise a refractory material, such as ceramic, as will be discussed in more detail below. Accordingly, in some embodiments, the assembled roll (220) comprises at least about 90% refractory ceramic material. Still other suitable configurations for roll (220) will be apparent to one with ordinary skill in the art in view of the teachings herein.

III. A ROLL ASSEMBLY COMPRISING A CORE WITHIN A REFRACTORY ROLL

Figure 12:
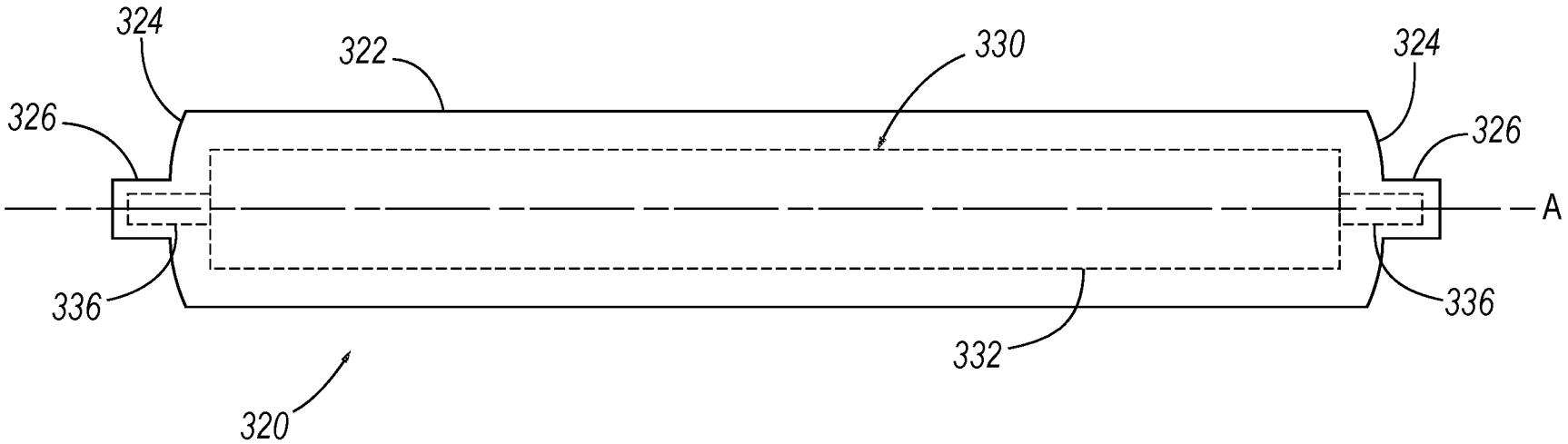
FIG. 12 depicts a front view of an alternative embodiment for the roll of the roll assembly of FIG. 4.

Another embodiment of a roll (320) is shown in FIG. 12 that may be incorporated into roll assembly (100). Roll (320) is substantially similar to roll (220), except that roll (320) comprises a steel core (330). As best seen in FIG. 12, core (330) comprises roll portion (332) and journal (336) extending from each side of roll portion (332). Core (330) may then be cast with a refractory material about the entire surface of core (330) to form an outer roll portion (322) and an outer journal (326) extending from each side of outer roll portion (322). For instance, the outer diameter of roll portion (332) of core (330) may be about 18.5 inches and the outer diameter of outer roll portion (322) may be about 22 inches to correspond to a refractory material thickness of about 2.25 inches, though other suitable dimensions may be used. Roll (320) may comprise a refractory material, such as ceramic, as will be discussed in more detail below.

Figure 15:
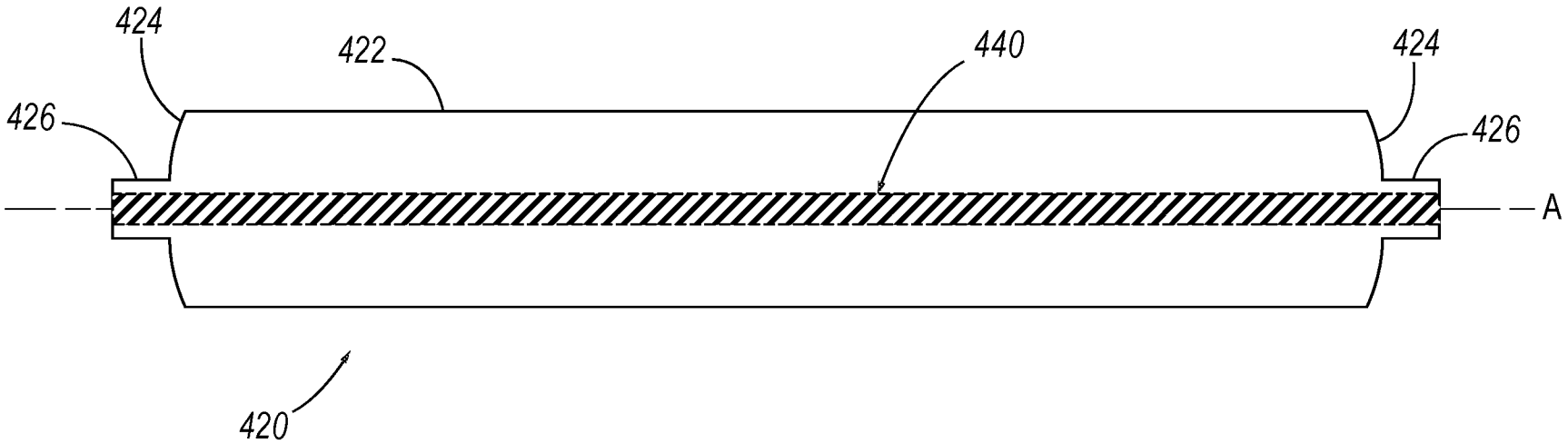
FIG. 15 depicts a cross-sectional view of an alternative embodiment for the roll of the roll assembly of FIG. 4.

Another embodiment of a roll (420) is shown in FIG. 15 that may be incorporated into roll assembly (100). Roll (420) is similar to roll (320), except that roll (420) comprises a steel core (440) extending longitudinally along the length of roll (420). In the illustrated embodiment, roll (420) comprises roll portion (422) and journal (426) extending from each side of roll portion (422). Roll portion (422) comprises a generally elongate cylindrical shape extending longitudinally along axis (A). The cylindrical shape of roll portion (422) is generally configured to receive steel sheet (60) to permit at least a portion of steel sheet (60) to wrap around at least a portion of roll portion (422).

Each journal (426) extends outwardly from roll portion (422) along longitudinal axis (A). Each journal (426) comprises a generally cylindrical shape with an outer diameter that is less than the outer diameter defined by roll portion (422). Each journal (426) is sized to be received by bore (114) of a respective bearing block (110). In the illustrated embodiment, a convex surface (424) is positioned between roll portion (422) and journal (426). Convex surface (424) may distribute stress more uniformly between roll portion (422) and journal (426) and/or reduce wear on bearing block (110). Though it should be noted that convex surface (424) is merely optional and other suitable surfaces may be used, such as straight and/or tapered surfaces.

Roll (420) may comprise a refractory material, such as ceramic, as will be discussed in more detail below. A steel core (440) is then positioned within roll (420) such that core (440) extends along a length of roll (420). Core (440) may act as a support rod having a substantially constant outer diameter along the length of the core to form a circular cross-sectional profile, or any other suitable shape such as square, triangular, rectangular, oval, hexagonal, octagonal, etc. In the illustrated embodiment, core (440) extends along the entire length of roll (420) from one end to the other. In other versions, core (440) may be centrally positioned within roll (420) and extend for less than the entire length of roll (420), such that core (440) only extends into a portion of each journal (426) or such that core (440) only extends within roll portion (422) of roll (420). Accordingly, core (440) may extend substantially along the length of roll (420) such as from about 50% to about 100% or such as from about 80% to about 100% of the length of roll (420). Still other suitable configurations for roll (420) will be apparent to one with ordinary skill in the art in view of the teachings herein.

Figure 1:
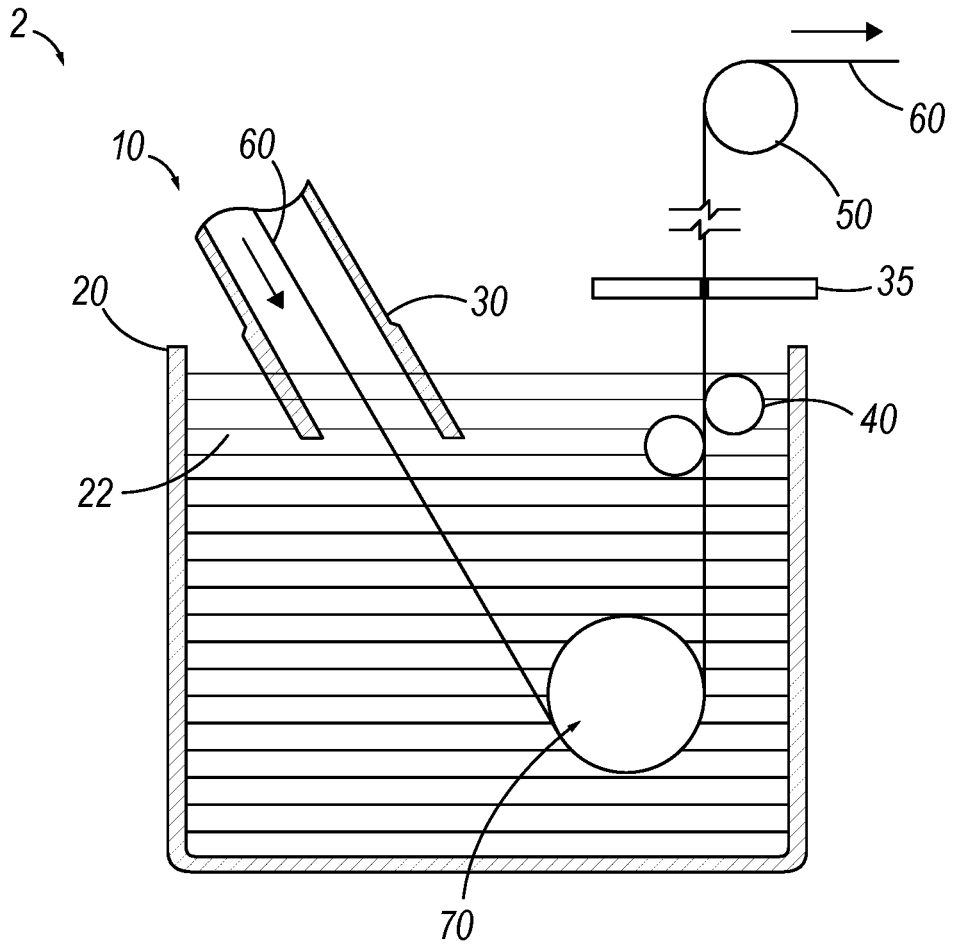
FIG. 1 PRIOR ART
FIG. 1 depicts a schematic view of a configuration of a coating portion in a continuous steel processing line.
Figure 1A:
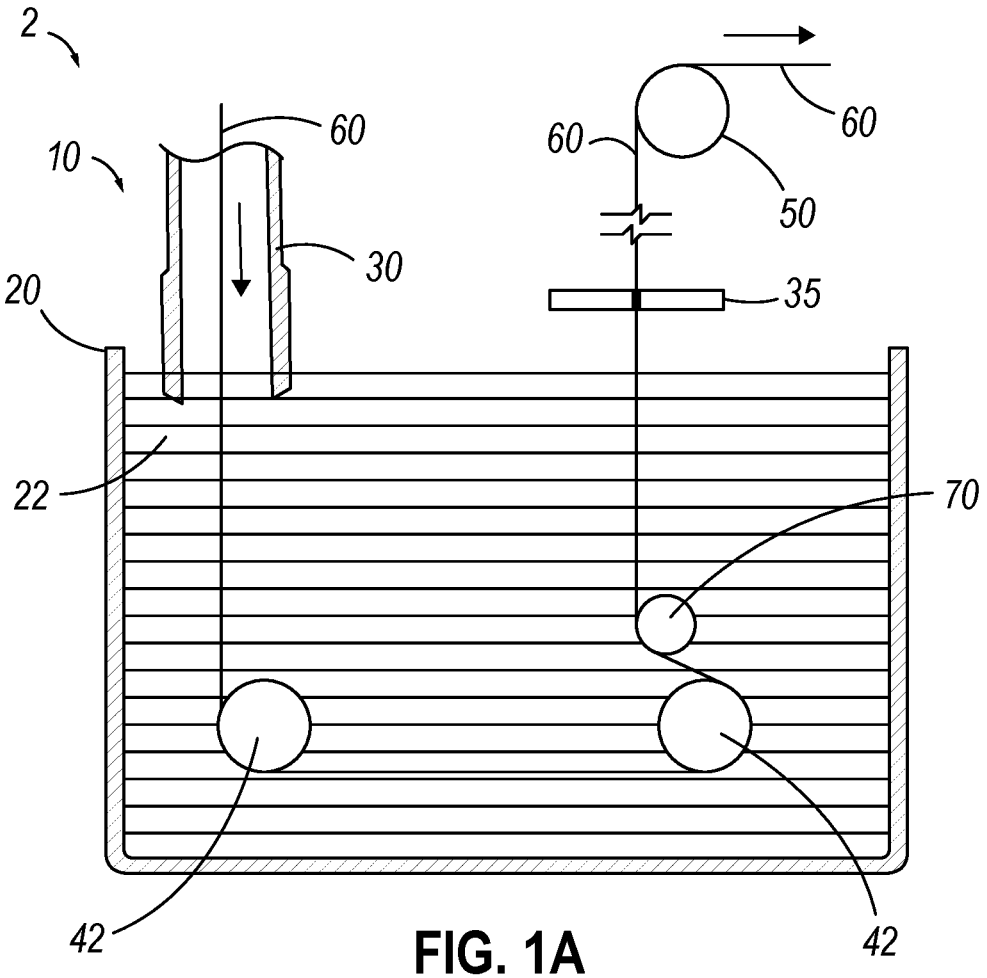
FIG. 1A PRIOR ART
FIG. 1A depicts a schematic view of an alternative configuration for the coating portion of FIG. 1.
Figure 2:
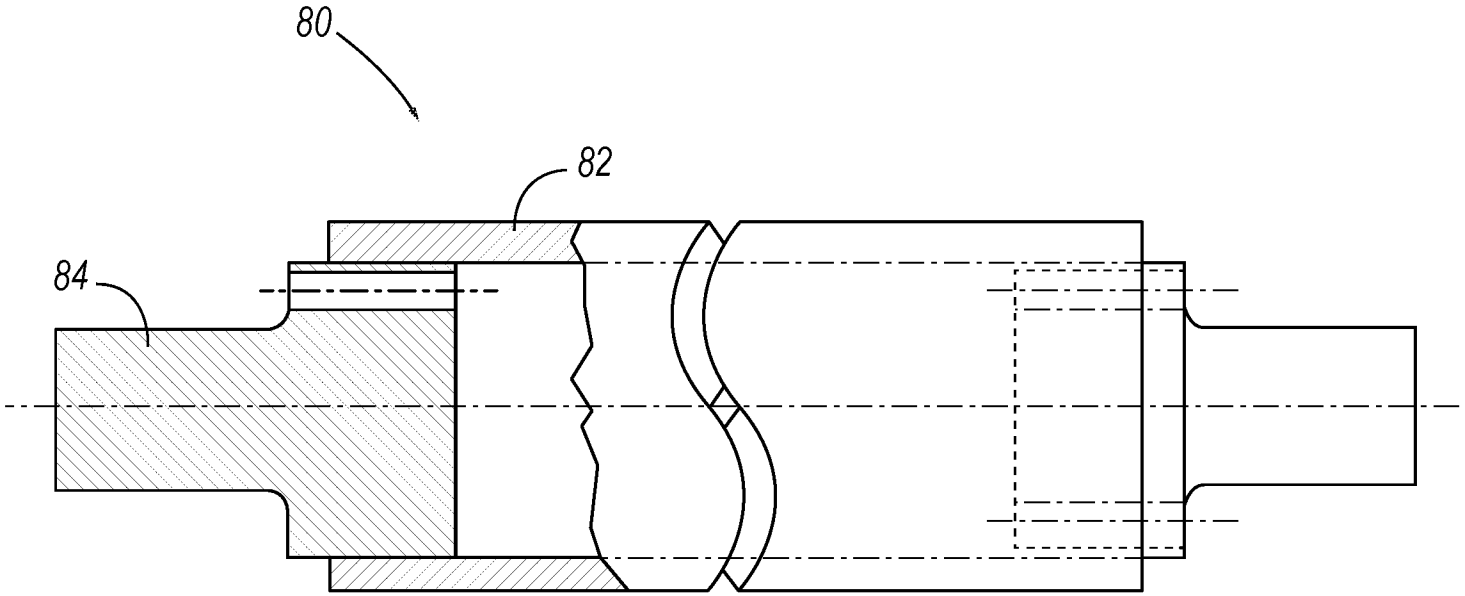
FIG. 2 PRIOR ART
FIG. 2 depicts a partial cross-sectional front view of a prior art roll for a roll assembly that may be used in the coating portion of FIG. 1.
Figure 3:
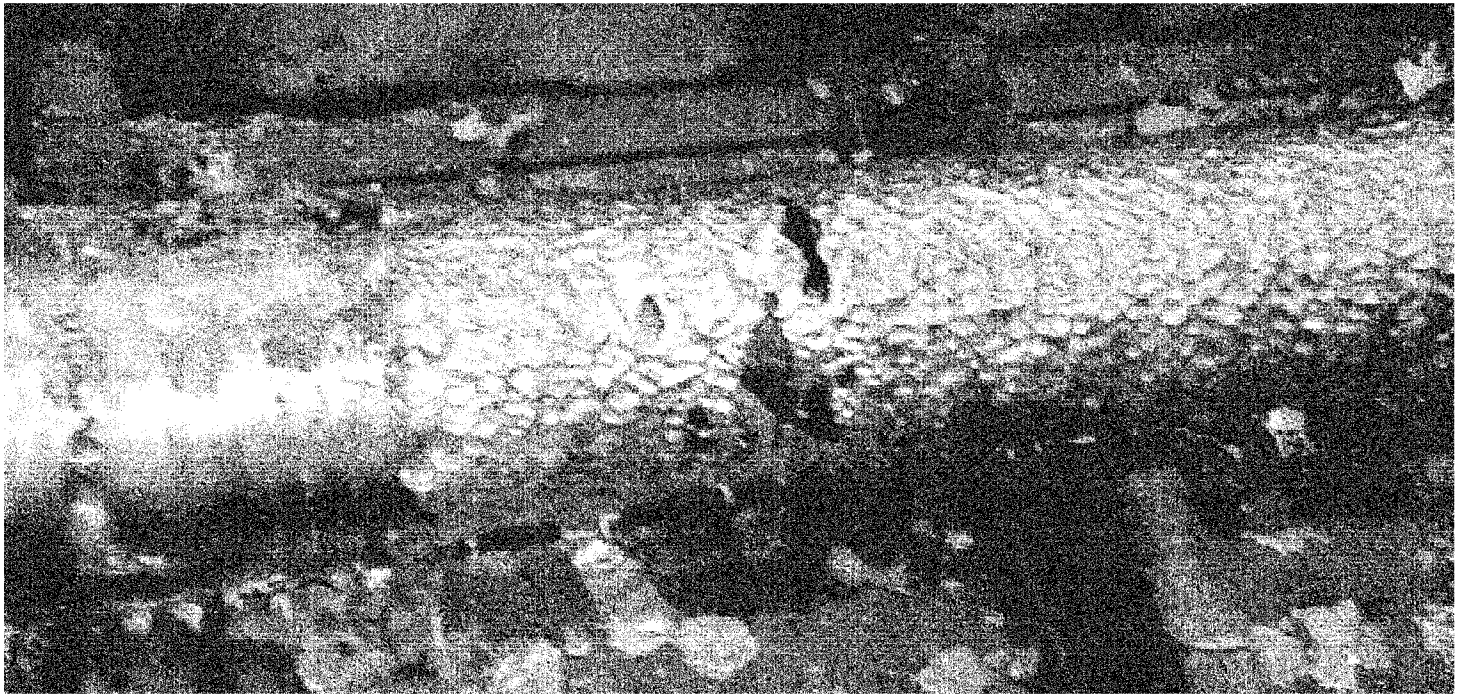
FIG. 3 PRIOR ART
FIG. 3 depicts a photo of the prior art roll of FIG. 2, showing degradation of the roll after being submersed within molten metal.
Figure 16:
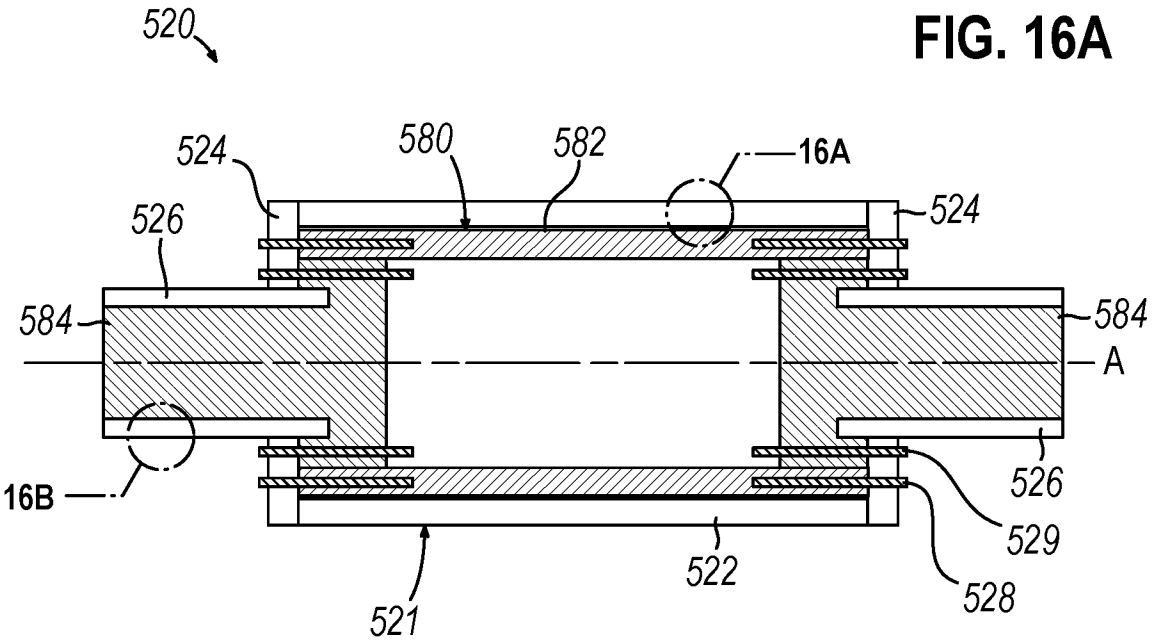
FIG. 16 depicts a cross-sectional view of an alternative embodiment for the roll of the roll assembly of FIG. 4.
Figure 17:
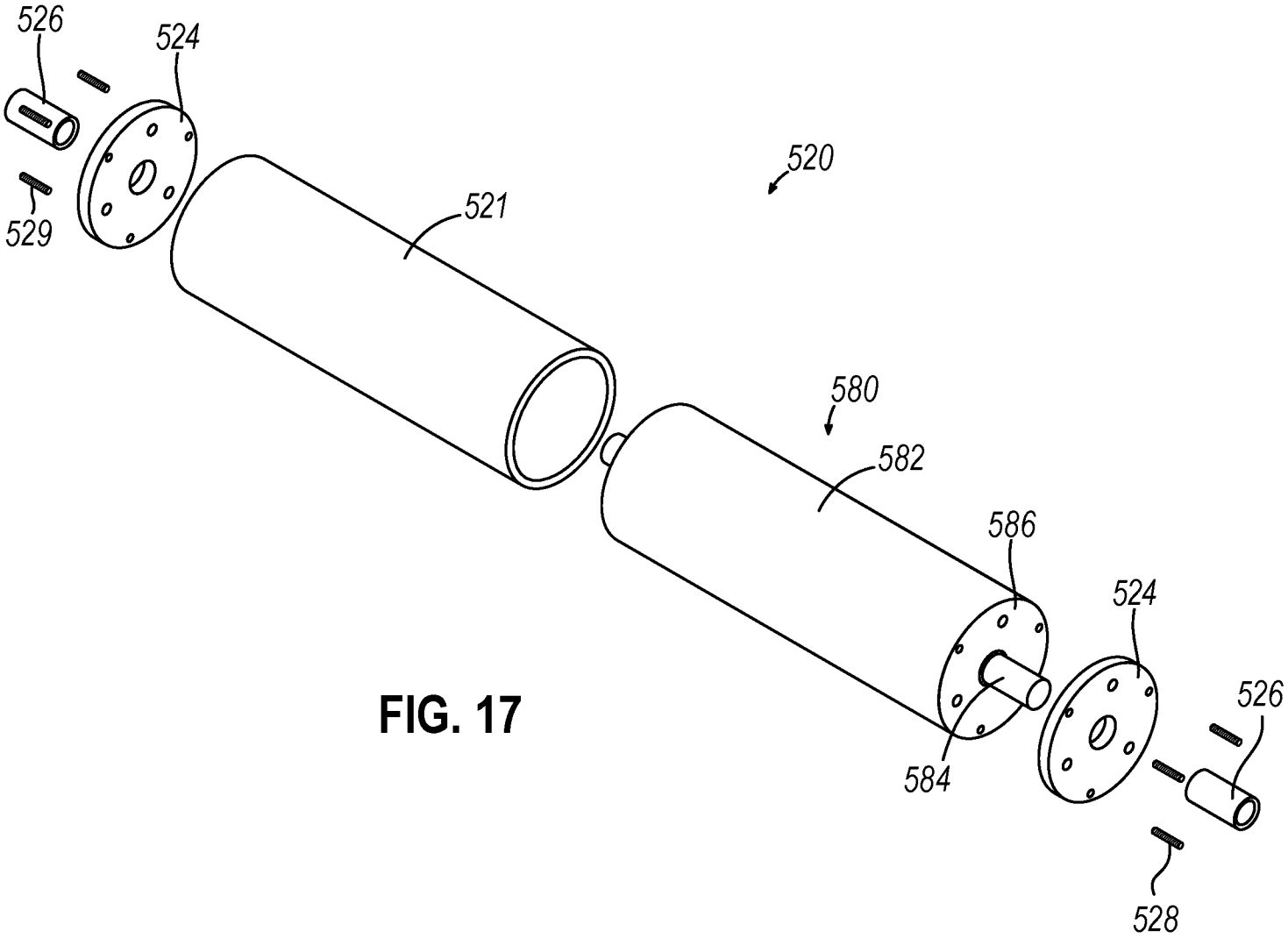
FIG. 17 depicts an exploded perspective view of the roll of FIG. 16.
Figure 19:
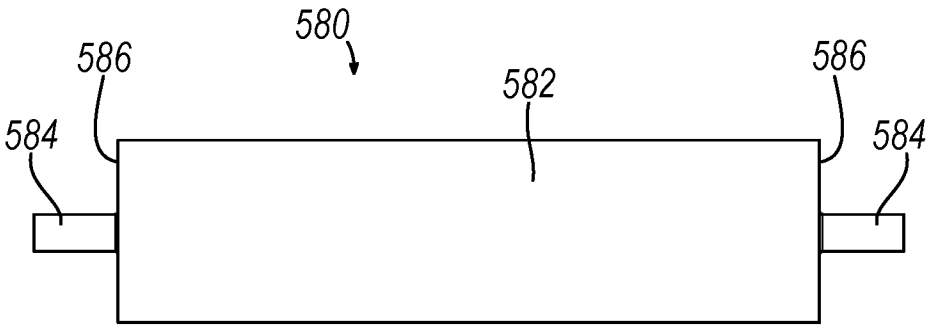
FIG. 19 depicts a front view of the core of FIG. 18.
Figure 20:
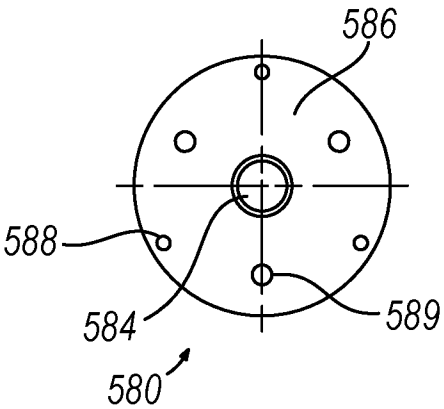
FIG. 20 depicts an end view of the core of FIG. 18.
Figure 18:
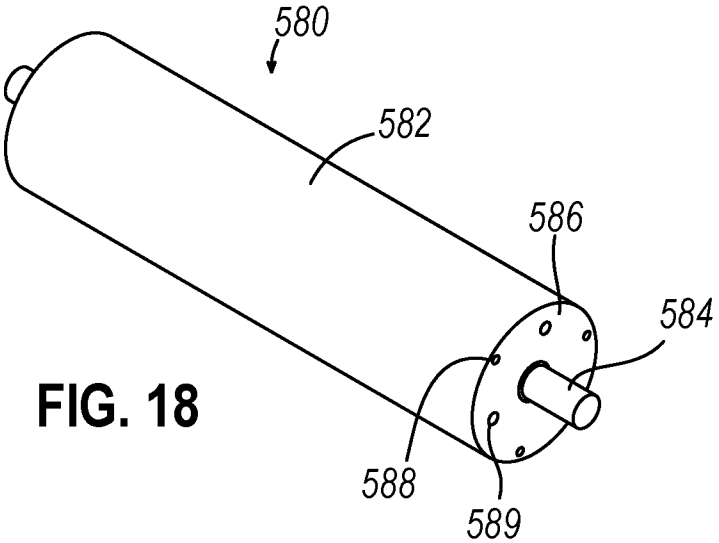
FIG. 18 depicts a perspective view of a core of the roll of FIG. 16.

Another embodiment of a roll (520) is shown in FIGS. 16-29 that may be incorporated into roll assembly (100). Referring to FIGS. 16-17, roll (520) comprises a core (580) positioned within a refractory shell (521). Core (580) is similar to a typical roll (80) as described above with respect to FIG. 2. For instance, referring to FIGS. 18-20, core (580) comprises a roll portion (582) with a pair of journals (584) extending outwardly from each end (586) of roll portion (582). Core (580) is generally made from steel, such as stainless steel and/or carbon and alloy steel. In some versions, core (580) may be formed from a composite or other suitable material. Core (580) may be formed by a single integral component or manufactured from a hollow tube with journal hubs welded onto each end, as shown in FIG. 16. In one embodiment, roll portion (582) of core (580) may comprise an outer diameter of about 18.5 inches and a length of about 72 inches, though other suitable dimensions may be used. In one embodiment, each journal (584) of core (580) may have an outer diameter of about 3.75 inches and a length of about 8.63 inches, though other suitable dimensions may be used.

Each end (586) of core (580) comprises a plurality of outer openings (588) extending inward about an outer portion of the circumference of each end (586) into the thickness of roll portion (582). Outer openings (588) are configured to receive a pin (528) to couple a portion of shell (521) with roll portion (582) as will be described in more detail below. Each end (586) of core (580) further comprises a plurality of inner openings (589) extending inward about an inner portion of the circumference of each end (586) into the thickness of each journal hub. Inner openings (589) are configured to receive a pin (529) to couple a portion of shell (521) with each journal hub as will be described in more detail below. The illustrated embodiment shows three outer openings (588) and three inner openings (589) positioned equidistantly about each end (586) of roll portion (582), but other suitable configurations for openings (588, 589) may be used.

Referring back to FIGS. 16-17, shell (521) comprises a roll sleeve (522), a pair of end plates (524), and a pair of journal sleeves (526). Accordingly, shell (521) may be cast about and/or assembled with core (580) such that roll sleeve (522) is positioned about roll portion (582) of core (580), each end plate (524) is positioned at each end of roll portion (582) of core (580), and each journal sleeve (526) is positioned about each journal (584) of core (580). Shell (521) may comprise refractory material, such as ceramic, as will be discussed in more detail below.

Figure 22:
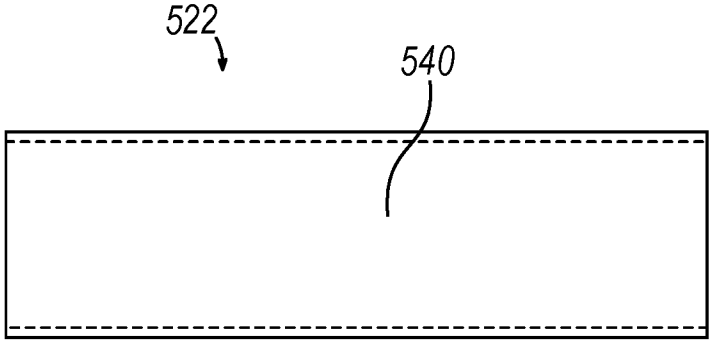
FIG. 22 depicts a front view of the roll sleeve of FIG. 21.
Figure 23:
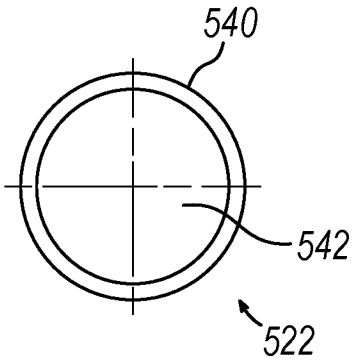
FIG. 23 depicts an end view of the roll sleeve of FIG. 21.
Figure 21:
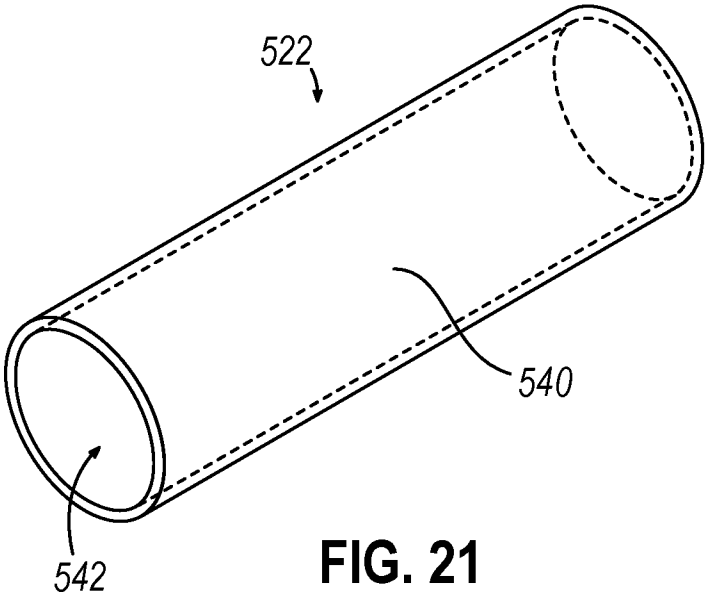
FIG. 21 depicts a perspective view of a roll sleeve of the roll of FIG. 16.

As shown in FIGS. 21-23, roll sleeve (522) comprises a generally cylindrical body (540) defining a bore (542) longitudinally through body (540). Body (540) may have a length that corresponds to the length of roll portion (582) of core (580). In one embodiment, body (540) may have a thickness of about 2.5 inches, though other suitable dimensions may be used. Bore (542) may have a diameter that generally corresponds to the outer diameter of roll portion (582) of core (580). For instance, roll portion (582) of core (580) comprises a substantially continuous smooth outer surface such that the outer surface of roll portion (582) maintains a substantially circular profile about the outer circumference of roll portion (582) along the length of roll portion (582). The interior of bore (542) of the present embodiment also comprises a substantially continuous smooth interior surface such that the inner surface of bore (542) maintains a substantially circular profile about the inner circumference of bore (542) along the length of bore (542). Accordingly, roll sleeve (522) is positioned about roll portion (582) such that roll portion (582) is received within bore (542) of roll sleeve (522). Roll sleeve (522) may thereby provide a durable non-reactive barrier about roll portion (582) of core (580).

Figure 16A:
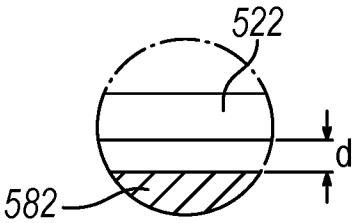
FIG. 16A depicts an enlarged partial cross-sectional view of a portion of the roll of FIG. 16 encircled by 16A in FIG. 16.

Referring to FIG. 16A, the present example includes a predetermined clearance (d) between the inner diameter of bore (542) and the outer diameter of roll portion (582). Initially, it was theorized that this clearance (d) could be derived from the difference between the thermal expansion ratio of roll portion (582) and the thermal expansion ratio of roll sleeve (522) such that once both roll portion (582) and roll sleeve (522) approach the temperature of dip tank (20), this clearance (d) would be substantially eliminated. However, in the present example, the clearance (d) between bore (542) and roll portion (582) is unexpectedly not exclusively tied to the thermal expansion ratios of roll portion (582) and roll sleeve (522). In particular, it has been found that some clearance (d) between roll portion (582) and roll sleeve (522) at the temperature of hot dip tank (20) is beneficial to improving the durability of roll sleeve (522) during the coating procedure. Thus, it should be understood that in the present example at least some clearance (d) may be maintained between the inner diameter of bore (542) and the outer diameter of roll portion (582) throughout the coating procedure.

Although the clearance (d) between the inner diameter of bore (542) and the outer diameter of roll portion (582) referred to above is described as being beneficial for improving the durability of roll sleeve (522), it should be understood that this clearance (d) is also limited in the present example. For instance, if the clearance (d) between the inner diameter of bore (542) and the outer diameter of roll portion (582) is too significant, some wetting of the molten aluminum (22) may occur, thereby transporting molten metal (22) into the clearance (d) between the inner diameter of bore (542) and the outer diameter of roll portion (582). Although this may depend at least in part on the material of roll sleeve (522), it should be understood that in the present example the clearance (d) between the inner diameter of bore (542) and the outer diameter of roll portion (582) is limited so as to minimize or prevent transport of molten metal (22) into the clearance (d). The clearance (d) between bore (542) and roll portion (582) may also be limited to prevent slipping between roll sleeve (522) and roll portion (582) when roll (520) is rotated by friction between steel sheet (60) and roll (520).

Accordingly, the inner diameter of bore (542) of roll sleeve (522) is sized corresponding to the outer diameter of roll portion (582) to provide a clearance fit between roll portion (582) and roll sleeve (522). Such a clearance fit may have a minimum clearance (d) sufficient to prevent cracking of roll sleeve (522) upon thermal expansion of roll portion (582) and a maximum clearance (d) to prevent transport of molten metal (22) into the clearance (d) and/or to prevent slipping between roll sleeve (522) and roll portion (582). In some examples, a suitable clearance (d) at operating temperature may be between about 0.001 inches and 0.012 inches.

The fit between roll portion (582) and roll sleeve (522) and the weight roll portion (582) causes roll sleeve (522) to generally rotate simultaneously with roll portion (582) even though roll portion (582) and roll sleeve (522) are not mechanically coupled with a locking mechanism. This allows roll sleeve (522) to rotate with roll portion (582) to prevent wear to roll portion (582). Further, roll sleeve (522) may be assembled with typical existing roll portions (582) to repair and/or reuse such roll portions (582).

Figure 26:
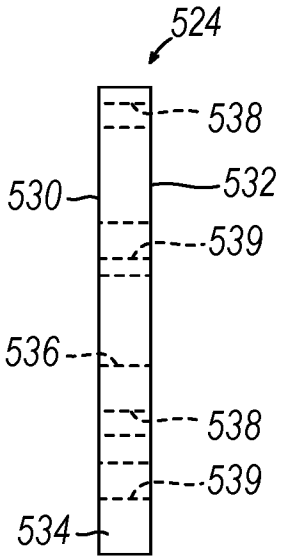
FIG. 26 depicts a side elevational view of the end plate of FIG. 24.
Figure 25:
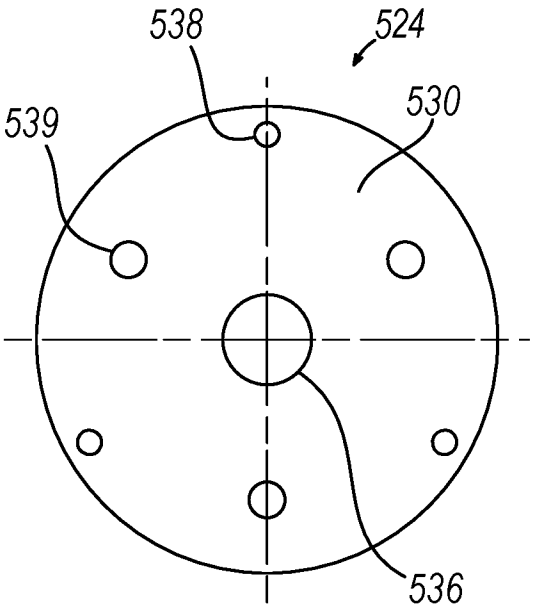
FIG. 25 depicts a front view of the end plate of FIG. 24.
Figure 24:
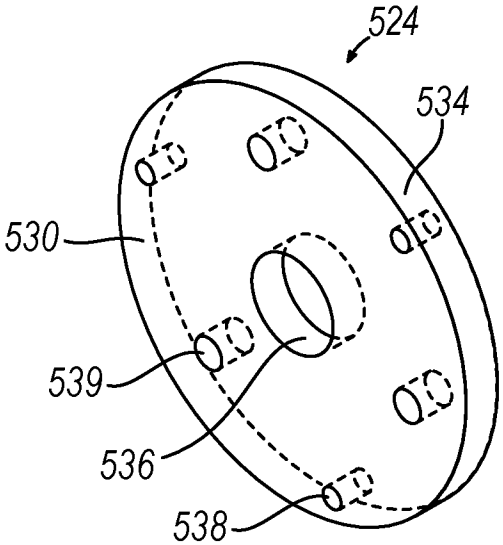
FIG. 24 depicts a perspective view of an end plate of the roll of FIG. 16.

Referring to FIGS. 24-26, an end plate (524) of shell (521) is shown in more detail. Each end plate (524) comprises a generally circular body (534) having an inner surface (530) and an outer surface (532). In one embodiment, body (534) may have an outer diameter that corresponds to the outer diameter of roll sleeve (522) and a thickness of about 2.13 inches, though other suitable dimensions may be used. Body (534) further comprises a bore (536) extending through a central portion of body (534) from inner surface (530) to outer surface (532). Bore (536) may be sized to receive journal (584) and journal sleeve (526) within bore (536) as will be described in more detail below.

End plate (524) comprises a plurality of outer openings (538) extending through an outer portion of body (534) from inner surface (530) to outer surface (532). Outer openings (538) may be aligned with outer openings (588) of core (580) and configured to receive pin (528) to couple end plate (524) with roll portion (582). Each end plate (524) further comprises a plurality of inner openings (539) extending through an inner portion of body (534) from inner surface (530) to outer surface (532). Inner openings (539) may be aligned with inner openings (589) of core (580) and configured to receive pin (529) to couple end plate (524) with each journal hub. The illustrated embodiment shows three outer openings (538) and three inner openings (539) positioned equidistantly about each end plate (524) of shell (521), but other suitable configurations for openings (538, 539) may be used. End plate (524) thereby rotates simultaneously with core (580) and may act as a non-reactive barrier and/or reduce wear to each end (586) of core (580).

Figure 29:
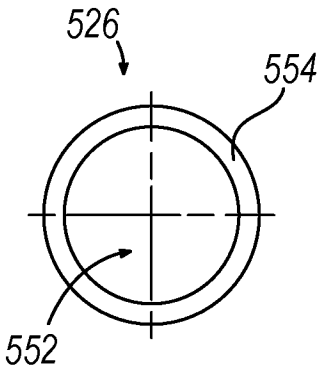
FIG. 29 depicts an end view of the journal sleeve of FIG. 27.
Figure 28:
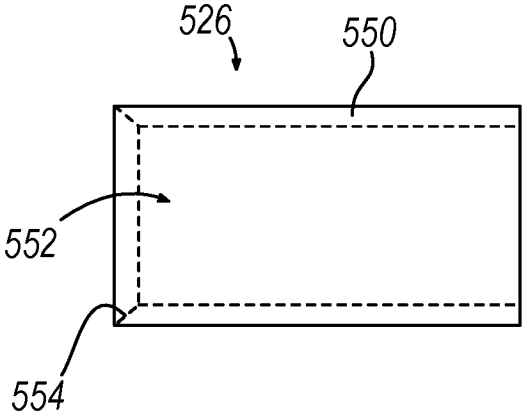
FIG. 28 depicts a front view of the journal sleeve of FIG. 27.
Figure 27:
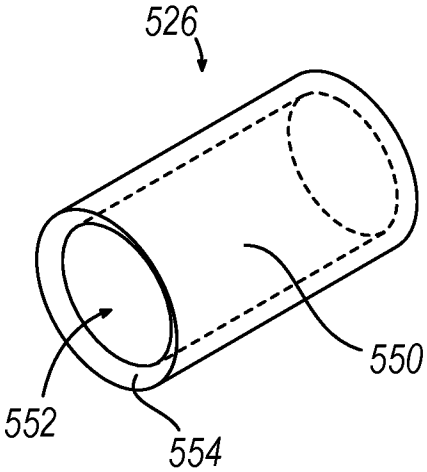
FIG. 27 depicts a perspective view of a journal sleeve of the roll of FIG. 16.

As shown in FIGS. 27-29, journal sleeve (526) comprises a generally cylindrical body (550) defining a bore (552) longitudinally through body (550) to receive a respective journal (584). Accordingly, an end of journal sleeve (526) and journal (584) may extend through bore (536) of end plate (524). At least one side of body (550) may include a chamfered or beveled edge (554). Edge (554) is generally configured to abut an interface between a respective journal (584) and roll portion (582). Although edge (554) is shown has having a generally chamfered or beveled shape, it should be understood that any other suitable shape may be used such as a fillet shape, a squared shape, a j-groove, or etc. Body (550) may have a length that corresponds to the length of journal (584) of core (580). Body (550) may have a thickness of about 0.5 inches, though other suitable dimensions may be used. Bore (552) may have a diameter that generally corresponds to the outer diameter of journal (584) of core (580).

For instance, each journal (584) of core (580) comprises a substantially continuous smooth outer surface such that the outer surface of each journal (584) maintains a substantially circular profile about the outer circumference of journal (584) along the length of journal (584). The interior of bore (552) of the present embodiment also comprises a substantially continuous smooth interior surface such that the inner surface of bore (552) maintains a substantially circular profile about the inner circumference of bore (552) along the length of bore (552). Accordingly, journal sleeve (526) is positioned about a respective journal (584) such that journal (584) is received within bore (552) of journal sleeve (526). Journal sleeve (526) may thereby provide a durable non-reactive barrier about journal (584) of core (580).

Figure 16B:
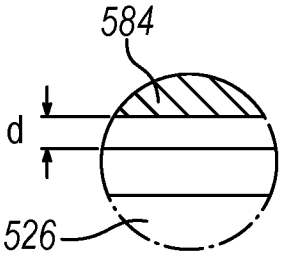
FIG. 16B depicts an enlarged partial cross-sectional view of a portion of the roll of FIG. 16 encircled by 16B in FIG. 16.

Referring to FIG. 16B, the present example includes a predetermined clearance (d) between the inner diameter of bore (552) and the outer diameter of journal (584). Initially, it was theorized that this clearance (d) could be derived from the difference between the thermal expansion ratio of journal (584) and the thermal expansion ratio of journal sleeve (526) such that once both journal (584) and journal sleeve (526) approach the temperature of dip tank (20), this clearance (d) would be substantially eliminated. However, in the present example, the clearance (d) between bore (552) and journal (584) is unexpectedly not exclusively tied to the thermal expansion ratios of journal (584) and journal sleeve (526). In particular, it has been found that some clearance (d) between journal (584) and journal sleeve (526) at the temperature of hot dip tank (20) is beneficial to improving the durability of journal sleeve (526) during the coating procedure. Thus, it should be understood that in the present example at least some clearance (d) may be maintained between the inner diameter of bore (552) and the outer diameter of journal (584) throughout the coating procedure.

Although the clearance (d) between the inner diameter of bore (552) and the outer diameter of journal (584) referred to above is described as being beneficial for improving the durability of journal sleeve (526), it should be understood that this clearance (d) is also limited in the present example. For instance, if the clearance (d) between the inner diameter of bore (552) and the outer diameter of journal (584) is too significant, some wetting of the molten aluminum (22) may occur, thereby transporting molten metal (22) into the clearance (d) between the inner diameter of bore (552) and the outer diameter of journal (584). Although this may depend at least in part on the material of journal sleeve (526), it should be understood that in the present example the clearance (d) between the inner diameter of bore (552) and the outer diameter of journal (584) is limited so as to minimize or prevent transport of molten metal (22) into the clearance (d). The clearance (d) between bore (552) and journal (584) may also be limited to prevent slipping between journal sleeve (526) and journal (584) when roll (520) is rotated by friction between steel sheet (60) and roll (520).

Accordingly, the inner diameter of bore (552) of journal sleeve (526) is sized corresponding to the outer diameter of journal (584) to provide a clearance fit between journal (584) and journal sleeve (526). Such a clearance fit may have a minimum clearance (d) sufficient to prevent cracking of journal sleeve (526) upon thermal expansion of journal (584) and a maximum clearance (d) to prevent transport of molten metal (22) into the clearance (d) and/or to prevent slipping between journal sleeve (526) and journal (584). In some examples, a suitable clearance (d) at operating temperature may be between about 0.001 inches and 0.012 inches.

The fit between journal (584) and journal sleeve (526) and the weight of core (580) causes journal sleeve (526) to generally rotate simultaneously with journal (584) even though journal (584) and journal sleeve (526) are not mechanically coupled with a locking mechanism. This allows journal sleeve (526) to rotate with journal (584) within bearing block (110) to prevent wear to journal (584). Further, journal sleeve (526) may be assembled with typical existing journals (584) to repair and/or reuse such journals (584). Other examples of sleeves are provided in U.S. Patent Publication No. 2018/0002796 entitled "Method for Extending the Campaign Life of Stabilizers for a Coating Line," filed on May 1, 2017, and U.S. patent application Ser. No. 16/263,044 entitled "Method for Extending the Campaign Life of Stabilizers for a Coating Line," filed on Jan. 31, 2019, the disclosures of which are incorporated by reference herein.

Still other suitable configurations for shell (521) of roll (520) will be apparent to one of ordinary skill in the art in view of the teachings herein. For instance, in some versions, only a select one or more of roll sleeve (522), end plate (425) and/or journal sleeve (526) of shell (521) may be used by themselves or in any suitable combination thereof.

Figure 31:
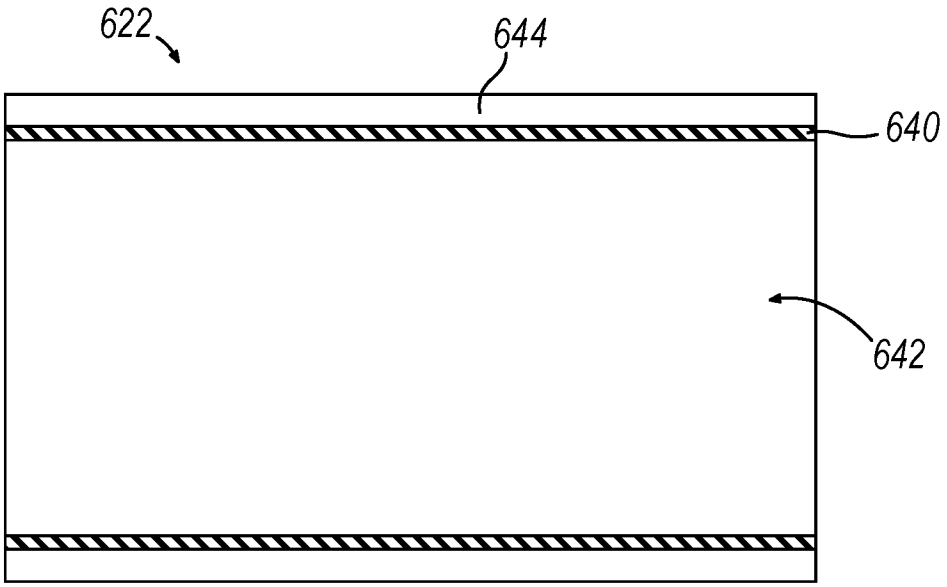
FIG. 31 depicts a cross-sectional view of the roll sleeve of FIG. 30 taken along line 31-31 of FIG. 30.
Figure 30:
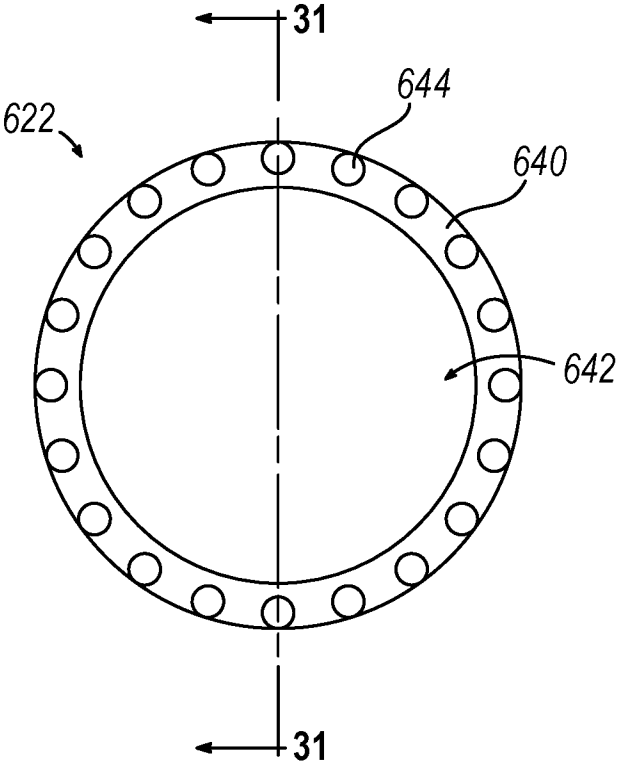
FIG. 30 depicts an end view an alternative embodiment of a roll sleeve.

FIGS. 30-33 show alternative embodiments of a roll sleeve (622, 722) that may be used as a portion of roll (520) or as a standalone component. As shown in FIGS. 30-31, roll sleeve (622) comprises a generally cylindrical body (640) defining a bore (642) longitudinally through body (640). Body (640) may have a length corresponding to a roll portion. In one embodiment, body (640) may have a thickness of about 0.5 inches, though other suitable dimensions may be used. Bore (642) may have a diameter that generally corresponds to the outer diameter of a roll portion. The interior of bore (642) of the present embodiment comprises a substantially continuous smooth interior surface such that the inner surface of bore (642) maintains a substantially circular profile about the inner circumference of bore (642) along the length of bore (642). Body (640) may comprise any suitable ferrous and/or non-ferrous material.

Figure 33:
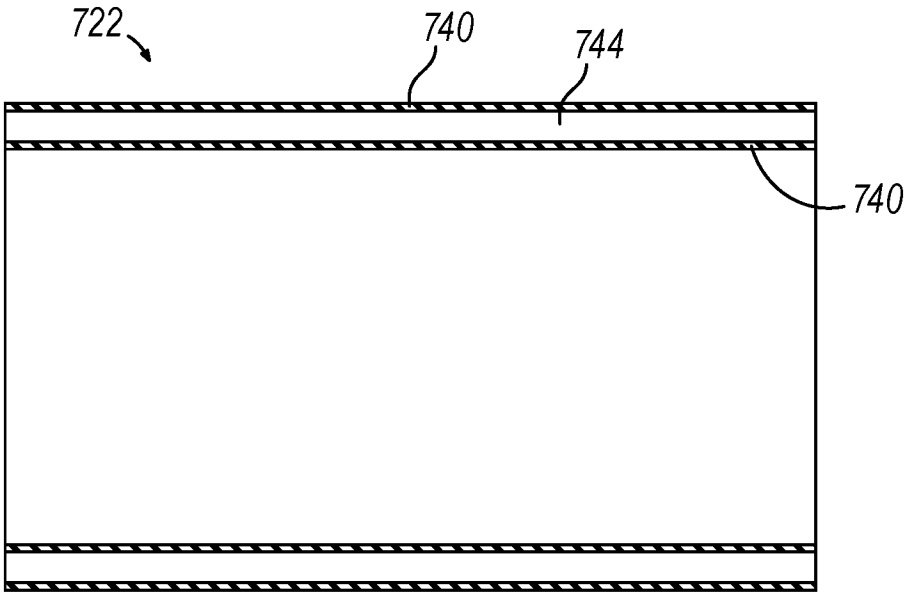
FIG. 33 depicts a cross-sectional view of the roll sleeve of FIG. 32 taken along line 33-33 of FIG. 32.
Figure 32:
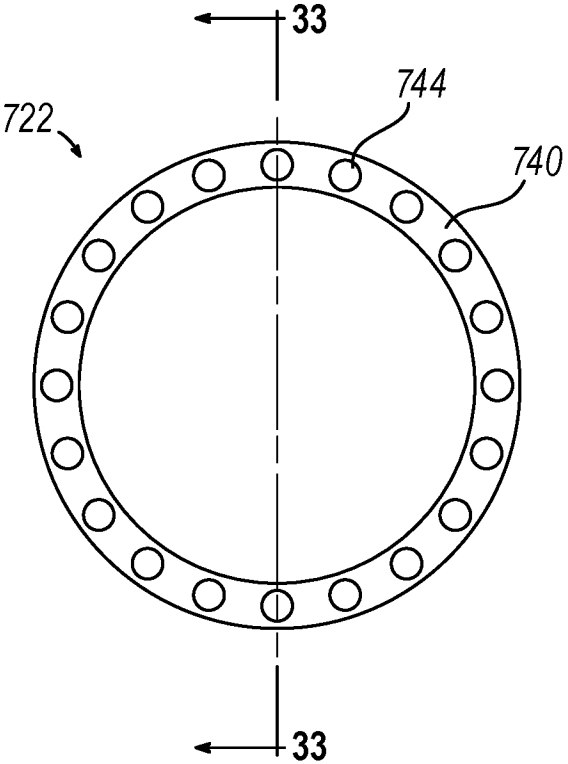
FIG. 32 depicts an end view an alternative embodiment of a roll sleeve.

Roll sleeve (622) further comprises a plurality of inserts (644) positioned about a circumference of roll sleeve (622). Each insert (644) is substantially cylindrical and may extend along a length of body (640). While the illustrate embodiment shows each insert (644) as having a circular profile, any other suitable shape may be used, such as square, rectangular, triangular, oval, etc. FIG. 30 also shows each insert (644) positioned tangentially with an exterior surface of body (640), but inserts (644) may be positioned in body (640) in other suitable configurations. For instance, FIGS. 32-33 show a roll sleeve (722) comprising inserts (744) positioned within body (740) of roll sleeve (722) such that each insert (744) is embedded within body (740). Referring back to FIGS. 30-31, each insert (644) has a thickness that is less than the thickness of body (640). In some versions, each insert (644) has a thickness that ranges from about 50% to about 100% of the thickness of body (640), such as about 55% to about 65%. The illustrated embodiment further shows 20 inserts (644) positioned about roll sleeve (622), but any other suitable number can be used, such as from about 0 to about 50, such as about 16 to about 30. Each insert (644, 744) comprises a ceramic material as will be discussed in more detail below. Accordingly, inserts (644, 744) of roll sleeve (622, 722) may thereby provide a durable non-reactive barrier about a roll portion. Still other suitable configurations for inserts (644, 744) will be apparent to one with ordinary skill in the art in view of the teachings herein.

IV. EXEMPLARY REFRACTORY MATERIALS

Any of the components described above for use in roll assembly (100) may comprise a refractory material, such as ceramic, that has high strength and is resistant to wear at high temperature. This refractory ceramic material may additionally have a low coefficient of thermal expansion, resistance to thermal shock, resistance to wetting by molten metal, resistance to corrosion, and is substantially chemically inert to molten metals. Such a refractory ceramic material may comprise silicon carbide (SiC), alumina ($Al_2O_3$), fused silica ($SiO_2$), or combinations thereof. In some versions, the refractory ceramic material comprises between about 5% and about 100% silicon carbide and/or alumina.

By way of example only, suitable refractory ceramic materials may include a class of ceramics known as SiAlON ceramics. SiAlON ceramics are high-temperature refractory materials that may be used in handling molten aluminum. SiAlON ceramics generally exhibit good thermal shock resistance, high strength at high temperatures, exceptional resistance to wetting by molten aluminum, and high corrosion resistance in the presence of molten non-ferrous metals. Such a SiAlON ceramic may comprise CRYSTON CN178 manufactured by Saint-Gobain High-Performance Refractories of Worcester, Mass., although numerous SiAlON class ceramics may be used.

Other suitable refractory ceramic materials may include a ceramic having about 73% $Al_2O_3$ and about 8% SiC. This ceramic may comprise GemStone 404A manufactured by Wahl Refractory Solutions of Fremont, Ohio. In another embodiment, a harder ceramic having a greater amount of SiC, such as about 70% SiC, may be used. In some versions, stainless steel wire needles may be added to the ceramic material, such as about 0.5 percent to about 30 percent by weight of the material. Such a ceramic may comprise ADVANCER nitride bonded silicon carbide manufactured by Saint-Gobain Ceramics of Worcester, Mass. or Hexology silicon carbide also manufactured by Saint-Gobain Ceramics of Worcester, Mass. Accordingly, components of roll assembly (100) may be made from the same refractory material or from different refractory material. Still other suitable refractory materials will be apparent to one with ordinary skill in the art in view of the teachings herein.

Components of roll assembly (100) may be made by casting the refractory ceramic material. In some other versions, components may be made by pouring liquid ceramic into a mold and using heat to bake the ceramic to remove moisture. An outer surface of the component may then be grinded to provide a smooth outer surface. Still other suitable methods to make the components of roll assembly (100) will be apparent to one with ordinary skill in the art in view of the teachings herein.

V. EXAMPLES

A series of tests were performed to evaluate roll assemblies. This series of tests is detailed below in the following Examples. It should be understood that the following examples are merely for illustrative purposes and that in other instances, various alternative characteristics may be used as will be understood by those of ordinary skill in the art in view of the teachings herein.

Example 1

Static dip testing of fused silica rods in a Type II aluminum coating bath was conducted. Fused silica round bars were used having a diameter of about 2.4 inches. The initial test was a 30-day immersion test. During the test, the fused silica underwent a full transformation, via a reduction reaction, to alumina. Neither loss of diameter, nor signs of chemical attack, were evident. There was also no wetting of the molten aluminum on the refractory surface. It was thereby determined that fused silica and/or alumina show a much greater resistance to material loss via chemical attack by molten aluminum to extend the life of rolls formed from fused silica and/or alumina.

Example 2

Figure 13:
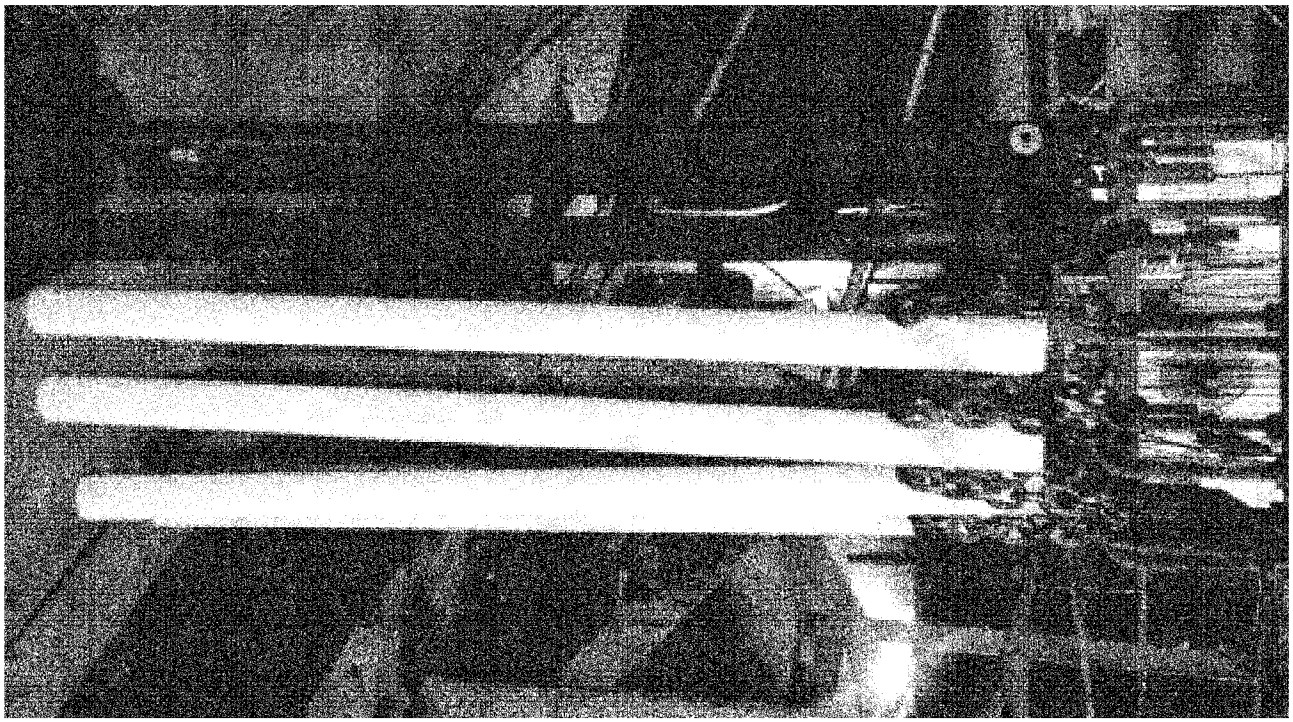
FIG. 13 depicts a photo of a plurality of fused silica rods prior to insertion within a molten aluminum bath.
Figure 14:
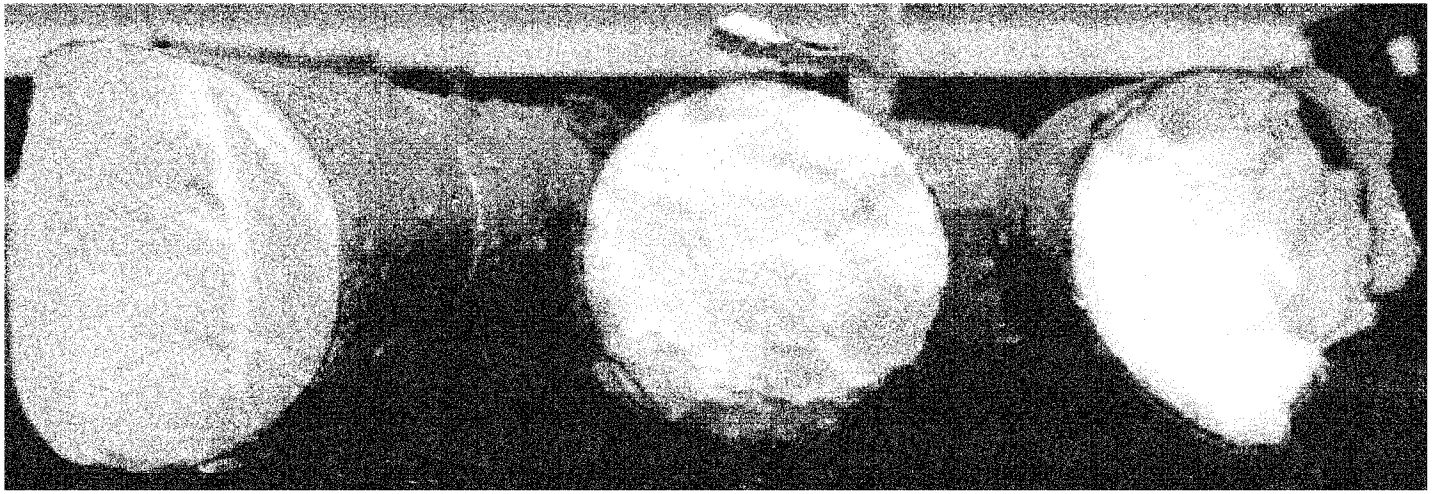
FIG. 14 depicts a cross-sectional view of the plurality of fused silica rods of FIG. 13 after insertion within the molten aluminum bath.

Static dip testing of fused silica rods in a Type II aluminum coating bath was conducted. Fused silica round bars were used having a diameter of about 2.4 inches. These bars are shown in FIG. 13 prior to immersion. After 9 days of immersion, a thin conversion layer of about 0.040 inches about the circumference of the bars was revealed where the fused silica was converted to alumina, as shown in FIG. 14. Again, neither loss of diameter, nor signs of chemical attack, were evident. There was also no wetting of the molten aluminum on the refractory surface. It was thereby determined that fused silica and/or alumina show a much greater resistance to material loss via chemical attack by molten aluminum to extend the life of rolls formed from fused silica and/or alumina.

Example 3

A load test was performed on a roll made from a single piece of solid Gemstone 404A ceramic material at room temperature. The roll portion of the roll had a length of about 76 inches and a diameter of about 10 inches. The journal of the roll had a length of about 4.5 inches and a diameter of about 4 inches. A load of about 650 lbf. was determined to be a maximum operating load for each journal. A load of about 1,300 lbf. was then applied to each journal. This load was increased in about 650 lbf. increments to a maximum load of about 3,650 lbf. Once the maximum load was reached and held for several minutes, the test was stopped. Both journals withstood this loading with no indications of cracking. Accordingly, it was determined that the ceramic roll was able to withstand the applied load in a coating line with a safety factor of about 5.5 above the determined maximum operating load.

Example 4

A roll test was performed on a roll made from fused silica. The roll was assembled with a steel bearing block and ran about 430,000 feet of steel. There was no significant loss of diameter on the roll journals or the body, but there was significant wear in the steel bearing block. While the bearing material was not suitable, the test of the roll was considered to be successful.

Example 5

A roll test was performed on a roll made from fused silica. The roll was assembled with a bearing block made from Gemstone 404A. The roll barrel diameter was about 10 inches. The roll was removed from the metal bath after running about 680,000 feet of steel. Based on a visual inspection of the roll, there appeared to be no significant wear between the roll and bearings and the roll was placed back into service. The roll then experienced failure after running about 780,000 feet of product. Upon removal, it was determined that both journals had fractured and separated from the roll. While the test of the roll was considered to be successful, the bearing material was considered to be too aggressive.

Example 6

A roll test was performed on a roll made from Gemstone 404A with wire needles. Steel rods were inserted into each journal of the roll. The roll was assembled with a bearing block made from Gemstone 404A. The roll barrel diameter was about 10 inches. The roll was removed from the metal bath after running about 0.88 million feet of steel. Based on a visual inspection of the roll, there appeared to be no significant wear between the roll and bearings. The test of the roll was considered to be successful.

What is claimed is:

1. A roll for use in a continuous coating line, wherein the roll comprises:

a core comprising a generally cylindrical roll portion and a journal extending axially from each end of the roll portion; and a shell positioned about the core, wherein the shell comprises a refractory ceramic material, wherein the shell comprises a roll sleeve having a bore extending therethrough configured to receive the core, wherein the roll sleeve is positioned about the roll portion of the core, wherein the bore of the roll sleeve is sized to provide a clearance fit between an inner surface of the bore and an outer surface of the roll portion of the core having a clearance between the inner surface of the bore and the outer surface of the roll portion such that the roll sleeve is rotatable with the core without an additional coupler.

2. The roll of claim 1, wherein the outer surface of the roll portion of the core is a substantially continuous smooth surface, wherein the inner surface of the bore of the roll sleeve is a substantially continuous smooth surface.

3. The roll of claim 1, wherein the clearance fit is sized to prevent ingress of molten metal between the roll sleeve and the roll portion of the core.

4. The roll of claim 1, wherein the clearance fit is between about 0.001 inches and 0.012 inches.

5. The roll of claim 1, wherein the shell comprises an end plate having a bore extending through the end plate configured to receive the journal of the core therein, wherein the end plate is positioned adjacent to an end surface of the roll portion of the core to substantially cover the end surface of the roll portion of the core.

6. The roll of claim 5, wherein the end plate is coupled with the roll portion of the core.

7. The roll of claim 5, wherein the end plate is coupled with a journal hub of the core.

8. The roll of claim 1, wherein the shell comprises a journal sleeve having a bore extending therethrough configured to receive the journal of the core.

9. The roll of claim 8, wherein an outer surface of the journal is a substantially continuous smooth surface, wherein an inner surface of the bore of the journal sleeve is a substantially continuous smooth surface, wherein the bore of the journal sleeve is sized to provide a clearance fit between an inner surface of the bore and the outer surface of the journal.

10. The roll of claim 9, wherein the clearance fit is sized to prevent ingress of molten metal between the journal sleeve and the journal.

11. The roll of claim 1, wherein the refractory ceramic material comprises a select one or more of silicon carbide, alumina, and fused silica.

12. The roll of claim 1, wherein the shell comprises between about 5% and about 100% of silicon carbide.

13. The roll of claim 1, wherein the shell comprises between about 5% and about 100% of alumina.

14. The roll of claim 1, wherein the core is steel.

15. A roll for use in a continuous coating line, wherein the roll comprises:

a core comprising a generally cylindrical roll portion and a journal extending axially from each end of the roll portion; and a shell couplable with the core, wherein the shell comprises a refractory ceramic material, wherein the shell comprises:

a roll sleeve having a bore extending therethrough configured to receive the core, wherein the roll sleeve is positioned about the roll portion of the core, a journal sleeve having a bore extending therethrough configured to receive the journal, wherein the journal sleeve is positioned about the journal of the core, and an end plate having a bore extending therethrough configured to receive the journal, wherein the end plate is positioned adjacent to an end surface of the roll portion of the core;

wherein the bore of the roll sleeve is sized to provide a clearance fit between an inner surface of the bore and an outer surface of the roll portion of the core, wherein the bore of the journal sleeve is sized to provide a clearance fit between an inner surface of the bore and an outer surface of the journal.

16. The roll of claim 15, wherein the clearance fit of both the roll sleeve and the journal sleeve is sized to prevent ingress of molten metal between the roll sleeve and the roll portion of the core.

17. The roll of claim 15, wherein the clearance fit of both the roll sleeve and the journal sleeve is between about 0.001 inches and 0.012 inches.

18. The roll of claim 15, wherein the end plate is couplable with core via a plurality of pins.

* * * * *